US006547362B2

(12) United States Patent
Subirada et al.

(10) Patent No.: US 6,547,362 B2
(45) Date of Patent: Apr. 15, 2003

(54) TEST-BASED ADVANCE OPTIMIZATION IN INCREMENTAL PRINTING: MEDIAN, SENSITIVITY-WEIGHTED MEAN, NORMAL RANDOM VARIATION

(75) Inventors: Francesc Subirada, Barcelona (ES); James A Mott, San Diego, CA (US); Oscar Martinez, Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/766,514

(22) Filed: Jan. 19, 2001

(65) Prior Publication Data

US 2002/0126171 A1 Sep. 12, 2002

(51) Int. Cl.[7] ..... B41J 29/393; B41J 29/38
(52) U.S. Cl. ..... 347/19; 347/14
(58) Field of Search ..... 347/19, 14, 7, 347/40, 23, 24, 10, 11, 12, 15, 5; 400/579

(56) References Cited

U.S. PATENT DOCUMENTS 5,297,017 A * 3/1994 Haselby et al. ..... 347/19
5,376,958 A * 12/1994 Richtsmeier et al. ..... 347/40
6,010,205 A * 1/2000 Billet ..... 347/40

* cited by examiner

*Primary Examiner*—John Barlow
*Assistant Examiner*—Charles W. Stewart, Jr.
(74) *Attorney, Agent, or Firm*—Ashen & Lippman

(57) ABSTRACT

A test pattern is scanned to find ideal print-medium advance for a pen (or other marking device). The pattern has a medium; and, marked on it, image patches each with overlapped swaths stepped by different distances. At best there are different-color pens; and for each distance a set of patches, each with a patch for each color (preferably area fills at sensitive tones by color). All patches in a set are best adjacent along a scan direction, with alignment lines above each set across the whole pattern, and a nozzle-conditioning patch at each image patch. A processor prints the pattern, operates a sensor and uses its signals to find optimum advance. The system finds and prints with ideal advance for a most-active pen; or weighs pen activity to find an optimum for all pens based on certain statistical and/or prospective choices.

33 Claims, 8 Drawing Sheets

FIG. 5
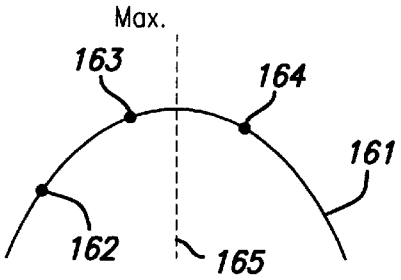
FIG. 6
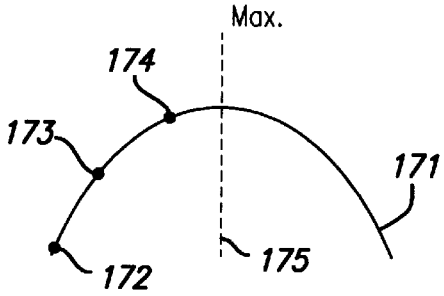
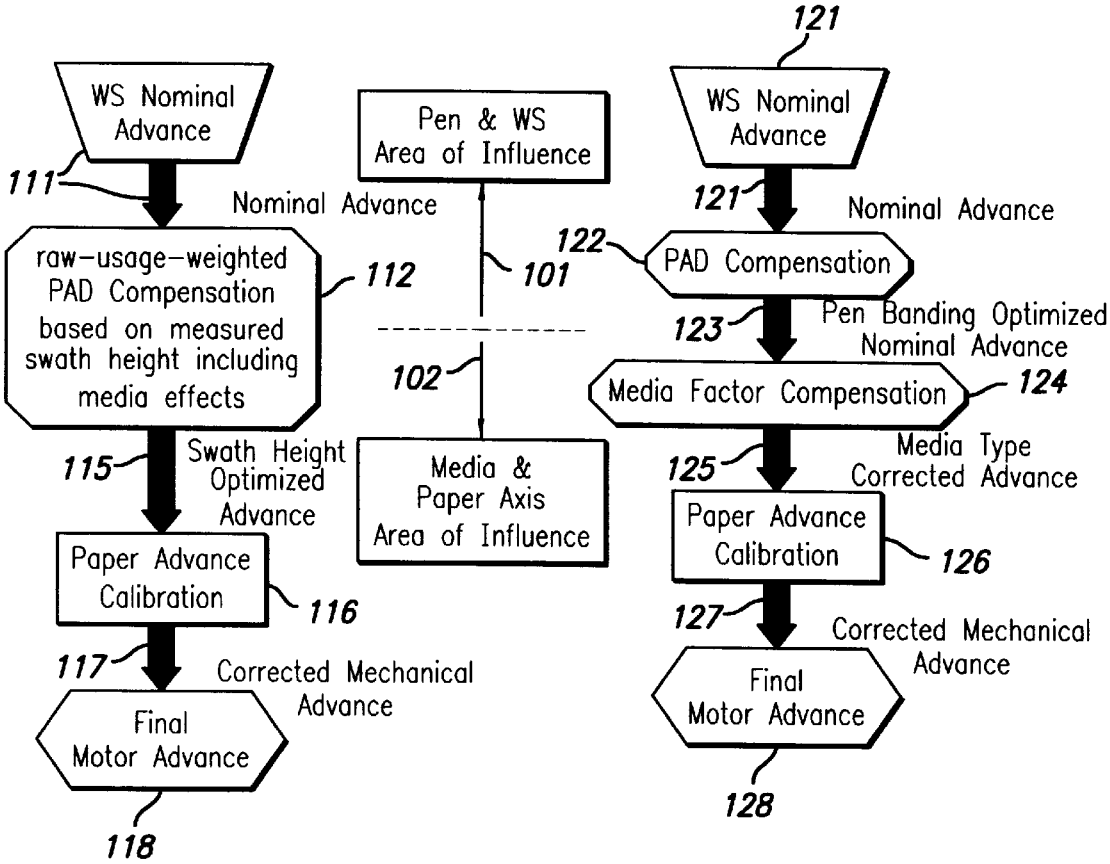
FIG. 7

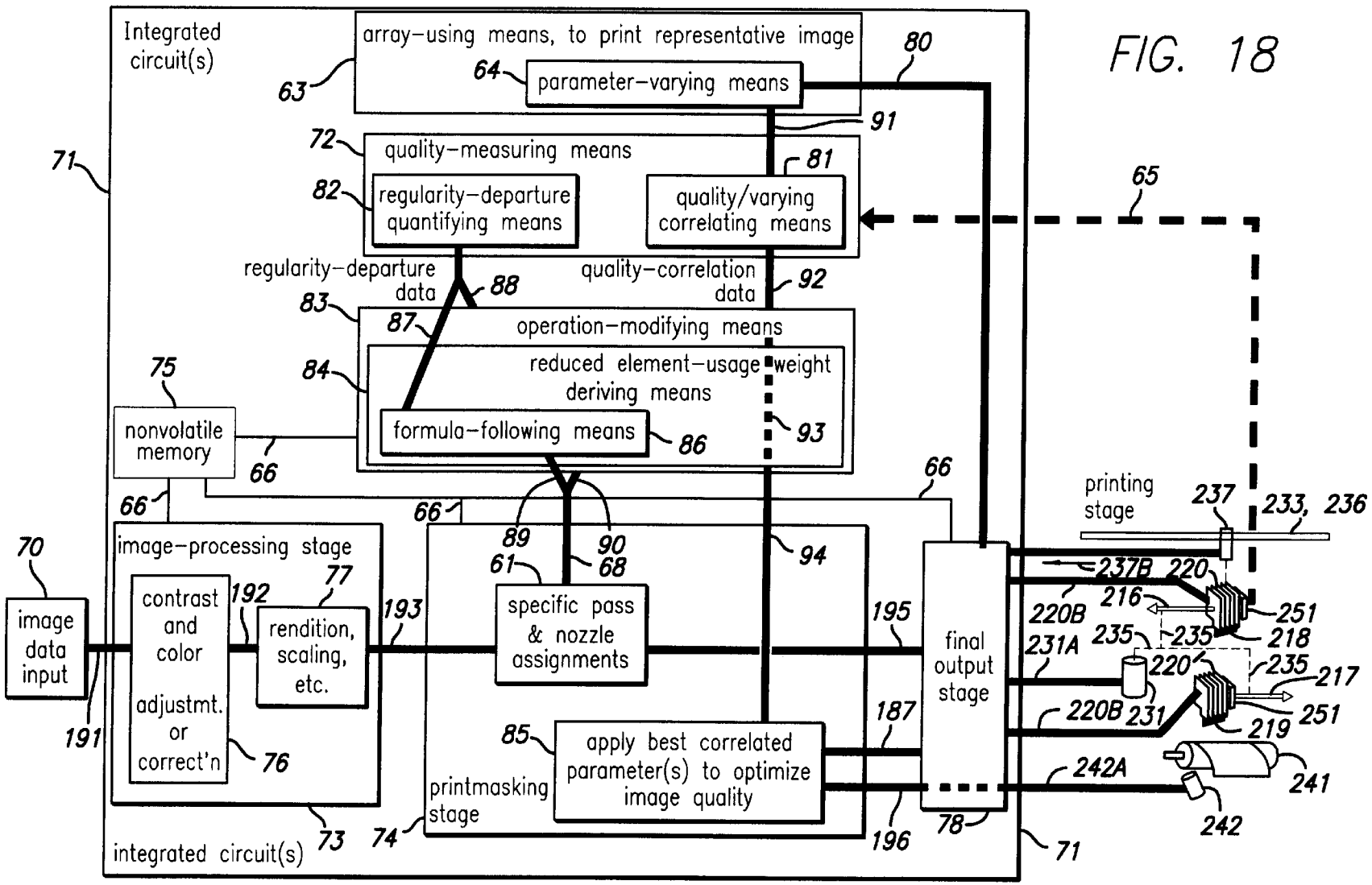
FIG. 18
array-using means, to print representative image
parameter-varying means
quality-measuring means
quality/varying correlating means
regularity-departure quantifying means
quality-correlation data
regularity-departure data
operation-modifying means
reduced element-usage weight deriving means
formula-following means
specific pass & nozzle assignments
apply best correlated parameter(s) to optimize image quality
printmasking stage
final output stage
printing stage
image-processing stage
rendition, scaling, etc.
contrast and color adjustmt. or correct'n
nonvolatile memory
image data input
Integrated circuit(s)
integrated circuit(s)

TEST-BASED ADVANCE OPTIMIZATION IN INCREMENTAL PRINTING: MEDIAN, SENSITIVITY-WEIGHTED MEAN, NORMAL RANDOM VARIATION

RELATED PATENT DOCUMENTS

Related documents are other, coowned U.S. utility-patent documents hereby incorporated by reference in their entirety into this document. One is in the names of David Donovan and Miquel Boleda, entitled "APPARATUS AND METHOD FOR MITIGATING COLORANT-DEPOSITION ERRORS IN INCREMENTAL PRINTING", patent application Ser. No. 09/688,610; another of Cluet et al., "PRINTING AND MEASURING DIRECTLY DISPLAYED IMAGE QUALITY, WITH AUTOMATIC COMPENSATION, IN INCREMENTAL PRINTING" —Ser. No. 09/642,418; another of Zapata et al., entitled "BANDING REDUCTION IN INCREMENTAL PRINTING, BY SPACING-APART OF SWATH EDGES AND RANDOMLY SELECTED PRINT-MEDIUM ADVANCE" —Ser. No. 09/516,816, issued as U.S. Pat. No. 6,336,702; another of Askeland, and entitled "BANDING REDUCTION IN INCREMENTAL PRINTING, THROUGH VARIATION OF NOZZLE COMBINATIONS AND PRINTING-MEDIUM ADVANCE" —Ser. No. 09/516,815; another of Thomas H. Baker et al., Ser. No. 09/183,819 entitled "COLOR-CALIBRATION SENSOR SYSTEM FOR INCREMENTAL PRINTING"; a further one of Chris T. Armijo et al., 08/811,412, "DETECTION OF NON-FIRING PRINT-HEAD NOZZLES BY OPTICAL SCANNING OF A TEST PATTEPN", and now issued as U.S. Pat. No. 6,352,331; still another in the names of Francis Bockman et al., Ser. No. 08/960,766, "CONSTRUCTING DEVICE-STATE TABLES FOR INKJET PRINTING", and issued as U.S. Pat. No. 6,178,008; and yet another in the name of Ramon Borrell, Ser. No. 09/146,858, "ENVIRONMENTAL AND OPERATIONAL COLOR CALIBRATION, WITH INTEGRATED INK LIMITING, IN INCREMENTAL PRINTING"; a further one in the name of Antonio Murcia et al., Ser. No. 09/211,713, "METHOD AND APPARATUS FOR HIDING ERRORS IN SINGLE-PASS INCREMENTAL PRINTING", issued as U.S. Pat. No. 6,270,187,; another of Francesc Subirada et al., Ser. No. 09/034,722, "SCANNING AN INKJET TEST PATTERN FOR DIFFERENT CALIBRATION ADJUSTMENTS", issued as U.S. Pat. No. 6,196,652; another in the names of Joan Manel Garcia-Reyero et al., Ser. No. 09/516,007, later converted to provisional No. 60/219,315, and nonprovisional application Ser. No. 09/632,197 based thereon, "IMPROVEMENTS IN AUTOMATED AND SEMIAUTOMATED PRINTMASK GENERATION FOR INCREMENTAL PRINTING" —and several earlier documents cited therein; another in the name of Jose-Julio Doval, provisional No. 60/179,383 and later nonprovisional application Ser. No. 09/693,524 based thereon, "COMPENSATION FOR MARKING-POSITION ERRORS ALONG THE PEN-LENGTH DIRECTION, IN INKJET PRINTING". Others are issued U.S. Pat. Nos. 6,062,137 of Shilin Guo et al., "APPLICATION OF SPECTRAL MODELING THEORY IN DEVICE-INDEPENDENT COLOR SPACE HALFTONING"; U.S. Pat. No. 5,980,016 of Gregory D. Nelson et al., "SYSTEMS AND METHOD FOR DETERMINING PRESENCE OF INKS THAT ARE INVISIBLE TO SENSING DEVICES"; U.S. Pat. No. 5,796,414 of Otto Sievert et al., "SYSTEMS AND METHOD FOR ESTABLISHING POSITIONAL ACCURACY IN TWO DIMENSIONS BASED ON A SENSOR SCAN IN ONE DIMENSION"; U.S. Pat. No. 5,644,343 of Ross Allen, "METHOD AND APPARATUS FOR MEASURING THE TEMPERATURE OF DROPS EJECTED BY AN INK JET PRINTHEAD"; and U.S. Pat. No. 5,430,306 of Hanno Ix, Ph. D., "OPTO-ELECTRONIC DETECTOR WITH HIGH, UNIFORM SENSITIVITY AND LARGE FIELD OF VIEW, FOR THERMAL-INKJET INKDROPS".

Also of interest in regard to malfunctioning-nozzle identification and compensation is U.S. Pat. No. 6,010,205 of Donald Billet, with Raster Graphics. That patent, however, is not incorporated by reference.

FIELD OF THE INVENTION

This invention relates to routine automatic calibration and recalibration of finished incremental-printer products, in the facilities of end-users. Such operation is to be distinguished from tests and measurements made in the course of research on or development of such printer products.

With this in mind, the invention relates generally to machines and procedures for incremental printing of text or graphics on printing media; and more particularly to a scanning machine and method that construct text or images from individual spots created on a printing medium, in a two-dimensional pixel array. Aspects of the invention include a test pattern, and methods and apparatus for printing, using, and analyzing a test pattern, to establish an optimum value for printing-medium advance between scans of the machine—or a series of print-medium advance values related to such an optimum value.

From the results the invention is able in some cases to optimize the image quality directly. In other cases the invention instead uses the results to identify weak or misdirected printing elements, and can exploit multipass print-mode techniques to divert operation from those elements to others.

BACKGROUND OF THE INVENTION

Incremental printers may produce many different kinds of undesired artifacts in printed images. These mainly include:

- repeating two-dimensional patterns due to dither-mask periodicity, or periodic relationships between dither and print masks;
- progressively expanding or unfolding shapes arising in error diffusion; and
- simple banding due to imperfectly abutted swaths, or to printing elements (nozzles, in inkjet printing) that are defective, or progressively inoperative (e.g. clogged, in inkjet printing), or incorrectly aimed.

The present invention addresses the third category, but is not primarily directed to swath abutment as such. Thus a principal target of the invention is malfunction of printing elements, although in some cases this in turn can produce a particular form of swath-abutment failure—and when it does, the present invention can be effective.

(a) Sources of banding—In scanning incremental printers it is well known that striations along the scan axis are a pervasive problem. Early innovations attacked the production of white or light lines due to inadequately precise printing-medium-advance mechanisms, and anomalously colored lines when subtractive primary colorants were superposed in inconsistent sequence.

More recently, the development of very inexpensive techniques for fabrication of inkjet nozzle arrays exceeding two and three centimeters in length has also introduced difficulties in control of aiming at the ends of the arrays. While that particular kind of printing-element malfunction has now been considerably mitigated, it still causes small but stubborn departures of printed swath height from printing-element-array height—and consequent banding.

With the improved control of end-element aiming, focus now shifts to malfunction of elements along the entire length of the array (though this may include the end elements). Artifacts due to these elements, as compared with those addressed earlier at the array ends, are quantitatively much finer—but so are the demands of the marketplace.

The consumer calls for progressively finer image quality, coupled with economy. Consequently a very significant problem remains in relatively subtle banding due to intermediate printing elements that are clogged, weak (e.g. due to firing-component tolerances or fatigue) or, again, mispointed.

(b) Identification of weak printing elements—Some workers in this field (see e.g. the Murcia document and also U.S. Pat. No. 6,010,205 mentioned above) have concentrated upon tactics for correcting known bad nozzles, simply leaving identification of those elements to other artisans. Some workers have proposed to monitor the dot-generating mechanism to predict failure—as for instance in measurement of inkjet nozzle temperature (as in the Allen document) to anticipate malfunction, or in sensing inkdrops in flight (as represented by the patent of Dr. Ix).

At least one earlier effort, represented by the Borrell document mentioned above, treats printing-element failure as a systematic result of environmental factors. Borrell measures parameters of the printer environment with an eye to entirely minimizing the occurrence of element failure.

The most direct approach, however, tries to isolate and quantitatively measure the failure itself—and to do so for each printing element individually. An ideal example of that approach for the inkjet environment appears in the previously mentioned Armijo document.

Armijo forms a test pattern with inkdrops from each nozzle (if functional) arrayed in a respective test group. He can then scan a sensor across each test group to detect functionality of each nozzle alone.

In his test pattern, a failed nozzle appears conspicuously as a missing dot in the overall test pattern. A weak nozzle appears as a dot of less than full, nominal saturation. A slightly misdirected nozzle, however, may be very difficult to detect from his test pattern.

Armijo's technique can be implemented with the naked eye, but is far more powerful when performed automatically and the results applied to initiating corrective action. His strategy provides excellent detailed information about every nozzle—except for incorrect aiming, as noted just above—but is time consuming.

(c) Related uses of sensors—Many different kinds of sensor measurements are made in laboratory and bench tests, or in preparation of color-rendering systems as in the Bockman and Guo documents—as distinguished from automatic measurements made in the field by operational printers. Some such lab measurements may quantify image quality.

The Guo document uses a carriage-mounted sensor to measure color averaged over an area, in color tiles, and applies spectral modeling to determine how to refine halftoning. The Bockman document is likewise addressed to preparing a product line as such, rather than to automatic operational field calibration of finished individual printers.

All such bench and lab uses of sensors are regarded as intrinsically different from routine operational calibration use of sensors in end-user facilities by a finished printer product. The field of the present invention is limited to such latter operational uses.

In general, as mentioned above, earlier approaches to operational determination of printing-element failure have set out to isolate and measure causes as such. Thus for instance the Doval document and the Subirada document both operate sensors over printed patterns to measure swath height and spacing, and then determine how to accommodate any error found.

Subirada in particular uses a bar-type pattern, and such patterns are also known (as in the Sievert and Nelson documents) for determining interpen alignments as well as imperfections—or some adverse results of broad tolerances—within individual printheads. Subirada's invention relates to banding reduction through adjustment of printing-medium advance.

To accomplish this, he performs a fixed matching of the print-medium advance to his measured swath height, or to a fraction of it. The Baker document teaches measurement of color balance with a sensor mounted on an auxiliary sensor carriage.

These earlier sensors ride on carriages which operate in the scan direction. Some of them, however, may be activated for measurements while the print-medium advance mechanism is operating.

(d) Printmode techniques—It is now very well known that image quality can be improved in many ways through scanning multielement printing arrays plural times (rather than only once) over each portion of a printing medium. Although such operation sacrifices throughput, it remains appealing where highest quality is an objective.

Such plural- or multipass printmodes entail laying down in each pass of the printing array (e.g. inkjet pen) only a fraction of the total ink required in each section of the image. Any areas left unaddressed after each pass are completed by one or more later passes.

An intrinsic benefit of this type of printing is a tendency to conceal the edges of each printed swath, and also to hide light lines formed where individual printing elements or groups of elements are not marking fully. Such a tendency is inherent simply because a missing pixel row is somewhat less conspicuous when superimposed on a printed (or partially printed) row of another pass, than when seen against an unprinted (usually white) background of a printing medium.

In liquid-colorant printing systems, plural-pass operation has additional benefits. It tends to control bleed, blocking and cockle by reducing the amount of liquid that is all on the page at any given time, and in addition may facilitate shortening of drying time—thus at least partially offsetting the poorer throughput during the printing process itself.

The specific partial-inking pattern employed in each pass is called a "printmask", and the way in which these different patterns add up to a single fully inked image is known as a "printmode". Heretofore, however, it has been recognized that printmodes and printmasks can themselves introduce undesired and conspicuous artifacts.

For example some printmodes use square or rectangular checkerboard-like patterns, which tend to create objectionable moiré effects when the patterns—or frequencies or harmonics generated within these patterns—are close to the patterns, frequencies or harmonics of interacting subsystems. As an example, such interferences may arise from dithering systems sometimes used to render an image.

In recent years major efforts have been made to mitigate problems of patterning, through introduction of randomization in the formation or selection of printmasks and dithering masks. These efforts have led in turn to realization, on the one hand, that randomized masks if stepped or "tiled"

through an image can themselves create undesirable strange and even bizarre patterns; and on the other hand that randomness can itself be excessive, leading to conspicuous granularity in printed images.

Also it has become more clear that there are different kinds of randomness—whose uncontrolled mixture can produce noticeable and undesirable inconsistencies in spatial-frequency content. Very recent innovations (particularly the several patent documents of Garcia-Reyero et al.) therefore undertake to control the degree and character of randomization employed, as well as the size of unit patterns to be repetitively tiled in an image.

Yet another difficulty appears with increasing image-quality demands: although somewhat less conspicuous in plural-pass printing, a missing row or group of rows yet can remain noticeable. This too is disadvantageous and has been addressed by Garcia-Reyero et al. through automatic reduction in usage, so-called "downweighting", of some known-weak or known-mispointed printing elements.

In dealing with thus-downweighted printing elements, recently introduced preferred technique includes automatic substitution of other elements. It remains to be seen, however, how best to identify printing elements that are weak, clogged, or incorrectly aimed.

If such elements can be found only through methods that consume undesirably large amounts of time, or colorant, or printing media, then the overall solution may yet be unacceptable. Thus—as to imperfectly functioning printing elements in general—even given extremely sophisticated corrective techniques, a limiting factor may yet be the identifying methods.

(e) Control of advance: nominal matching to pen height—Most recently attention has once again returned to the parameter that was the earliest identified cause of banding, namely the stroke of the printing-medium-advance system (and this is the focus of the present invention as well). The recent interest in control of the stroke, however, has been much more sophisticated than before.

Original solutions to primitive banding problems were simply to establish a print-medium advance that matched the nominal pen height, or to apply the colorant in plural passes for each region of an image. In the latter case, the print-medium advance would match some fraction of the nominal pen height.

This document will refer to these original solutions as providing a nominal printing-medium advance. The nominal advance is not only fixed but also lacks any basis in detection of printed characteristics, whether swath height or otherwise.

A difficulty with such settings is that in general the actual swath height departs from the nominal pen height. Therefore in general light-line or dark-line banding must necessarily result.

(f) Control of advance: fixed matching to swath height—As mentioned above, the cross-referenced Subirada document instead teaches reduction of banding through matching of the printing-medium advance to measured properties of some printed specimen. The control prescribed in that document, while of great value in the art, is relatively basic: a fixed, static matching of the advance stroke to the measured swath height, or to some fraction of that height.

A philosophy implicit in that innovation was that such matching would produce an advance value which was not merely nominal but instead ideal, though fixed. One limitation of this philosophy is that each pen (or other type of marking element) has its own respective ideal advance value, and these values for all the pens in a given printer seldom match.

(g) Control of advance: fixed matching to mean of ideal values—Yet only one value can be used by the printer at any given stroke; this leaves at least some of the pens using nonideal advance values. Accordingly some products have been configured—in the interest of minimizing adverse effects on image quality—to select a mean of the ideal advance values for the several pens in use.

Unfortunately this approach had at least two drawbacks. First, when one of the pens was statistically an outlier—that is to say, one whose ideal advance value was more than two or three standard deviations from the mean—inclusion of that outlier advance value in the mean would shift the mean very significantly toward the outlier value.

This shifting would minimize the conspicuousness of printing with the corresponding outlier color, so that a user would find it difficult to identify the outlier pen. Accordingly even though just one pen was causing most of the problem, and even if the user wished to optimize image quality by replacing a pen with a better one, the user would not be readily able to improve image quality by such a replacement.

On the other hand, exclusion of the outlier value from the mean would strongly exacerbate the image degradation due to the corresponding pen. In this case a user who wished to accept the adverse effects of a single mismatched pen (and thereby avoid cost and inconvenience of replacement) would be needlessly disappointed by the resulting image quality.

A second drawback of using the mean value was that some pens would be counted equally in calculating the mean even though those pens might be printing in a color (yellow, for instance, or light cyan) for which banding is relatively inconspicuous in comparison with other colors; and also even though those pens might not be printing at all in the image—or might not be printing much. This would be true as well even if they were not printing at all (or much) within a particular region of the image.

(h) Control of advance: fixed matching to weighted mean—Due to this second drawback, some products have been configured to select a weighted mean. Two types of such weighting are known: one involves weights designed into the system for the product line, based on the relative conspicuousness of printing in different colors or dilutions, or both; and the other also includes weights based on the number of inkdrops of each color/dilution fired in the immediately-last-printed segment of the image.

Even these weightings introduced adverse effects, from the equal significance attached to printing by pens being used to print dark shadowlike regions—or highlight regions—of an image. Banding is generally very inconspicuous in those tonal ranges, but the overall advance value was being shifted willy-nilly anyway in response to the ideal advance value of those pens.

Such a shift was not merely a harmless waste of attention, but rather in general degraded printing by pens being actually used to print midtones—for which banding is most conspicuous. Since banding in the highlight and shadow colors was not perceptibly improved, image quality in general suffered a net degradation.

A further difficulty with the inkdrop-weighted means is that they respond to patterns of ink usage in a segment already printed, and use the information to modify a different segment that is to be printed in the future. In general, usage in the two segments may be totally different; hence the system grinds through many calculations only to produce a shift in advance that may be wholly counterproductive.

(i) Control of advance: fixed matching to a direct measure of ideal value—It has since been suggested, as for instance by the Cluet document, that an ideal value might instead be found by measuring nonuniformity in nominally uniform-density printed tone patches or tiles. This was to be done without attempting to measure swath height as such.

Yet still it seemed to be contemplated that such an ideal advance would be a fixed value. In other words, while Cluet provides a very insightful strategy for ideal-value identification, he falls back to the slightly earlier concept of a single, fixed value when he reaches the next step of actually using that information.

(j) Control of advance: variable value—The Zapata and Askeland documents depart from the general philosophy of an advance that is fixed and ideal, and instead introduce benefits of an advance that varies, and preferably varies randomly. These inventions seek to solve banding problems through variation and randomness of advance, thereby circumventing the notable difficulties of introducing variation and randomness in printmasking.

Accordingly these innovations are extremely valuable in the art. Nevertheless they lack any suggestion of obtaining the earlier-disclosed benefits of a fixed ideal advance value too—that is to say, at the same time. Some specific advance distances, in point of fact, are better than others.

(k) Conclusion—As this discussion shows, limitations in the accuracy, speed and economy of methods for identifying failed or failing printing elements (and for correcting, accommodating or compensating for those identified elements) continue to impede achievement of uniformly excellent inkjet printing. In particular, these limitations include some problems that have been known in the field for some while but are amplified by the advent of inkjet pens two and a half centimeters (one inch) long. Thus important aspects of the technology used in the field of the invention are amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is a test pattern for determining optimum printing-medium advance in an incremental printer that uses an image-marking device which prints in a particular colorant. The pattern includes a printing medium; and, marked on the printing medium, plural representative image patches for the particular colorant.

Each of the representative image patches includes plural overlapping swaths of the colorant. Corresponding features of the overlapping swaths are spaced by a certain distance selected for each of the patches respectively. The certain distances are different for the plural patches, respectively.

The foregoing may represent a description or definition of the first aspect or facet of the invention in its broadest or most general form. Even as couched in these broad terms, however, it can be seen that this facet of the invention importantly advances the art.

In particular, the novel test pattern enables objective evaluation of image quality in its dependence upon the spacing of overlapping swaths—i.e., upon the advance stroke. In this way the novel test pattern facilitates determination of optimum advance distance, without any need or effort to measure printing-element array height.

Although the first major aspect of the invention thus significantly advances the art, nevertheless to optimize enjoyment of its benefits preferably the invention is practiced in conjunction with certain additional features or characteristics. In particular, if the test pattern is to be used for determining optimum advance in the printer, and the image-marking device includes plural marking units for marking in plural different particular colorants respectively, then preferably the patches include for each certain distance a set of plural patches; and each set includes at least one patch for each of the colorants.

In case the patches are in fact plural, one for each colorant as just described, then progressively nested subpreferences include the conditions that:

- in each set, all the patches be adjacent to one another along a scanning direction;
- plural alignment reference lines be printed in association with each set;
- the alignment reference lines be above each set; and
- the alignment lines extend across substantially the entire pattern.

Additional subsidiary preferences are that at least one nozzle-conditioning patch be associated with each of the representative image patches, and that nozzle-conditioning patches be adjacent to their associated representative image patches, along the scanning direction, and also that the representative image patches include area fills.

Such area fills, when used, are at different tonal levels for at least some of the different colorants, respectively. The tonal levels preferably are between twenty-five and fifty-five percent for yellow colorant, and between forty-five and seventy-five percent for at least one other full-strength colorant; and it is more strongly preferable that they be roughly forty percent for yellow colorant, and roughly sixty percent for the at least one other undiluted colorant.

Also preferably the tonal levels are between seventy-five and one hundred percent for at least some dilute colorants; and, still more particularly, roughly ninety percent for at least some dilute colorants. Another preference is that the "certain distances"—the distances by which the swaths are spaced apart—be distributed about a nominal value for the advance distance.

In preferred embodiments of its second major independent facet or aspect, the invention is a method of determining optimum printing-medium advance in an incremental printer that uses image-marking devices which print in respective different colors or color dilutions. The method includes the step of printing a test pattern that includes a set of representative image patches at each of plural printing-medium advance settings in turn.

Each set includes at least one representative image patch for each of the different colors or color dilutions. The method also includes the step of performing optical measurements of the test pattern to ascertain a relationship between the printing-medium advance settings and resulting image quality of the patches.

The foregoing may represent a description or definition of the second aspect or facet of the invention in its broadest or most general form. Even as couched in these broad terms, however, it can be seen that this facet of the invention importantly advances the art.

In particular, this aspect of the invention makes it possible to evaluate the advance-stroke setting for several pens or other marking devices all in a single procedure. This is particularly noteworthy because this method corresponds to actual printing of color images—i.e., printing with a number of marking devices all at once.

Although the second major aspect of the invention thus significantly advances the art, nevertheless to optimize enjoyment of its benefits preferably the invention is practiced in conjunction with certain additional features or characteristics. For example, preferably the method also includes the step of, in association with each representative image patch or set, printing either a nozzle-conditioning patch or an alignment reference line.

In preferred embodiments of its third major independent facet or aspect, the invention is an incremental printer for using image-marking devices to form images on a printing medium. The printer includes a support for the printing medium, and also a carriage for holding the marking devices and scanning the marking devices relative to the medium, to form images on the medium.

Further included is a printing-medium advance mechanism for progressively moving the medium relative to the carriage at right angles to the scanning. The printer also includes a sensor for measuring test-pattern image quality.

In addition the printer includes some means for performing certain control and operational functions. These means involve a programmed processor. It will be understood, however, that the program may be incorporated into such a processor in the course of manufacture—as is familiar for devices of the type known as "application-specific integrated circuits"—rather than being literally programmed into the processor later.

For breadth and generality in discussing the invention, these means will be called the "programmer processor means". One function of these means is controlling the carriage, the advance mechanism and the marking devices to print a test pattern.

The test pattern includes a set of representative image patches at each of plural printing-medium advance settings in turn. Each set includes at least one representative image patch for each of plural different colors. Another function of the controlling and operating means is operating the sensor and interpreting resulting signals from the sensor to determine optimum printing-medium advance.

The foregoing may represent a description or definition of the third aspect or facet of the invention in its broadest or most general form. Even as couched in these broad terms, however, it can be seen that this facet of the invention importantly advances the art.

In particular, this aspect of the invention is a piece of apparatus that can automatically obtain the benefits of the first two invention facets, discussed above. That is, this third aspect of the invention can automatically determine the best advance stroke that it can use with the particular set of marking devices that is actually in place.

Although the third major aspect of the invention thus significantly advances the art, nevertheless to optimize enjoyment of its benefits preferably the invention is practiced in conjunction with certain additional features or characteristics. In particular, preferably the invention also includes the image-marking devices; and preferably these include inkjet pens.

In addition the programmed processor means preferably further include some means for determining which particular marking device is most active in a particular swath of a desired image; and also determining an optimum medium advance for at least the particular marking device. The same means are also used for employing the optimum advance for that device in printing the particular swath.

An alternative preference is that the programmed processor means include means for determining the relative degree of activity of each marking device, respectively, in a particular swath of a desired image; and taking that relative degrees of activity into account in determining an optimum medium advance for all the marking devices considered in the aggregate, at the particular swath. The same means are also used for employing the optimum advance in printing the particular swath.

Certain contextual features, and certain elements of the inventive combinations themselves, are common to preferred embodiments of the fourth, fifth, sixth and seventh major independent facets or aspects of the invention. As to the common environmental or contextual features, in preferred embodiments of these four facets the invention is an incremental printer for using image-marking devices to form an image on a printing medium.

As to the elements of the inventive combinations themselves, the common elements of the printer include a support for the printing medium.

They also include a carriage for holding the marking devices and scanning the marking devices relative to the medium, to form the image on the medium. The common elements of the printer also include a printing-medium advance mechanism for progressively moving the medium relative to the carriage at right angles to the scanning.

Also included is a sensor for measuring test-pattern image quality; and means for performing certain operating and control functions. Although the specific functions are different from those mentioned earlier for the third facet of the invention, these means too will be called simply "programmed processor means".

The functions of the programmed processor means differ as among these four aspects of the invention. The different functions are specified below.

In preferred embodiments of the fourth independent facet of the invention, the functions of the programmed processor means comprise these three:

operating the sensor and interpreting resulting signals from the sensor to determine optimum printing-medium advance;

thereafter controlling the carriage, the advance mechanism, and the marking devices to employ particular printing-medium advance values while printing the image; and selecting the particular advance values to provide a sequence of values that varies about the determined optimum advance.

The foregoing may represent a description or definition of the fourth aspect or facet of the invention in its broadest or most general form. Even as couched in these broad terms, however, it can be seen that this facet of the invention importantly advances the art.

In particular, this form of printing-medium advance control is the first to achieve in combination the banding-reduction benefits of optimization with those of variation. More specifically, the optimization benefits may predominate for those pens whose ideal advance is especially close to the overall optimum stroke, while the variation benefits may predominate for those pens whose ideal advance is more remote.

Although the fourth major aspect of the invention thus significantly advances the art, nevertheless to optimize enjoyment of its benefits preferably the invention is practiced in conjunction with certain additional features or characteristics. In particular, preferably the sequence of values is a pseudorandom sequence perturbed to preferentially include values relatively nearer to the determined optimum advance.

Thereby the banding-reduction benefits of randomization in printing-medium advance are added to those of variation per se and those of optimization, discussed above. For this case, in one particularly preferable implementation the sequence of values is obtained by combination of a normal distribution with a pseudorandom number generator, substantially according to the function $A_P$ exhibited below—$A_P$ being the printing-medium advance and $A_O$ a nominal advance value.

$$A_P(f_1|_{all\ 1}) \equiv A_O \cdot \mathrm{NORMAL}[f_M(\mathrm{rand}), \sigma_f]$$

with the distribution truncated to the lower and upper PBF values, where $$\mathrm{NORMAL} \equiv \mu + \frac{\sigma}{2}\sqrt{-\sigma^2 \cdot \ln[rand(1)]} \cdot \cos[2\pi\ rand(1)]$$

$\sigma \equiv \sigma_f$, standard deviation of all $f_1$ $$\mu \equiv f_M \equiv \frac{\sum_{i=1}^{N} f_i}{N},$$

N≡number of pens, maximum value of i rand(x)≡a function that generates uniformly distributed random numbers from 0 through x $$\mathrm{NORMAL} \equiv f_M + \frac{\sigma_f}{2}\sqrt{-\sigma_f^2 \cdot \ln[rand(1)]} \cdot \cos[2\pi\ rand(1)]$$

so $$A_p \equiv A_O\left(f_M + \frac{\sigma_f}{2}\sqrt{-\sigma_f^2 \cdot \ln[rand(1)]} \cdot \cos[2\pi\ rand(1)]\right)$$

(truncated as mentioned above).

In preferred embodiments of its fifth major independent facet or aspect, the programmed processor means are for performing these functions, rather than those listed above for earlier-discussed facets of the invention:

operating the sensor and interpreting resulting signals from the sensor to determine an optimum printing-medium advance for each marking device respectively; and thereafter controlling the carriage, the advance mechanism, and the marking devices to employ a particular printing-medium advance value that is substantially the median of the optimum advances for the image-marking devices respectively.

The foregoing may represent a description or definition of the fifth aspect or facet of the invention in its broadest or most general form. Even as couched in these broad terms, however, it can be seen that this facet of the invention importantly advances the art.

In particular, in comparison with using a mean of the optimum advances, this aspect of the invention helps to identify a single pen or other image-marking device that is least compatible with the others. This capability is valuable because it enables a user to obtain a significant image-quality improvement simply by replacing that one device.

Although the fifth major aspect of the invention thus significantly advances the art, nevertheless to optimize enjoyment of its benefits preferably the invention is practiced in conjunction with certain additional features or characteristics. In particular, preferably this fifth facet of the invention can be practiced in conjunction with other aspects—for example the above-mentioned variation of advance, in this case a variation about the median.

In preferred embodiments of its sixth major independent facet or aspect, the programmed processor means are for performing these functions:

operating the sensor and interpreting resulting signals from the sensor to determine an optimum print-medium advance for each marking device respectively;

thereafter determining, for a specific image swath, the image density contributed by each marking device respectively; and thereafter controlling the carriage, the advance mechanism, and the marking devices to employ a particular printing-medium advance value that is substantially a sensitivity-weighted mean of the optimum advances for the image-marking devices respectively.

The sensitivity-weighted mean is calculated substantially by weighting an optimum advance value for each marking device by the sensitivity of banding to printing density for a color in that image-marking device respectively.

The foregoing may represent a description or definition of the sixth aspect or facet of the invention in its broadest or most general form. Even as couched in these broad terms, however, it can be seen that this facet of the invention importantly advances the art.

In particular, use of sensitivity weighting introduces a far more sophisticated and effective advance-selection criterion than known heretofore. For instance, earlier weighting schemes revolved about merely a numerical counting of colorant quantities dispensed from each pen respectively.

Such a sheerly numerical counting is vulnerable to excessive emphasis on the effects of pens that are not printing color tones which are susceptible to serious banding problems. The present invention emphasizes exactly those tones, for reference in determining ideal advance stroke, and thereby makes improvements that are readily perceivable.

Although the sixth major aspect of the invention thus significantly advances the art, nevertheless to optimize enjoyment of its benefits preferably the invention is practiced in conjunction with certain additional features or characteristics. In particular, preferably the specific image swath is a swath that is prospectively to be printed; and the particular printing-medium advance value is employed for the specific image swath prospectively to be printed. Further the sensitivity-weighted mean is preferably found substantially according to the expression exhibited below.

$$A_P(f_i|_{all\ i}) \equiv A_O\ f_{MWS}$$

where $$f_{MWS} \equiv \frac{\sum S_i(\rho_i)W_i f_i}{\sum S_i(\rho_i)W_i}$$

$$A_p \equiv A_O \frac{\sum S_i W_i f_i}{\sum S_i W_i}$$

In preferred embodiments of its seventh major independent facet or aspect, the programmed processor means are for performing these functions:

operating the sensor and interpreting resulting signals from the sensor to determine an optimum printing-medium advance for each marking device respectively;

thereafter determining, for a specific image swath that is prospectively to be printed, a characteristic of the image components to be contributed by each marking device respectively; and thereafter, for the specific image swath that is prospectively to be printed, controlling the carriage, the advance mechanism, and the marking devices to employ a particular printing-medium advance value that is a function of the determined characteristic of image components to be contributed by each device respectively.

The foregoing may represent a description or definition of the seventh aspect or facet of the invention in its broadest or most general form. Even as couched in these broad terms, however, it can be seen that this facet of the invention importantly advances the art.

In particular, here the invention selects the advance stroke based on portions of the image that are to be printed, in the future, with that selected stroke—rather than based upon portions that have already been printed, and for which it is too late to choose a suitable stroke.

Although the seventh major aspect of the invention thus significantly advances the art, nevertheless to optimize enjoyment of its benefits preferably the invention is practiced in conjunction with certain additional features or characteristics. In particular, preferably the specific image swath is to be printed substantially immediately.

All of the foregoing operational principles and advantages of the present invention will be more fully appreciated upon consideration of the following detailed description, with reference to the appended drawings, of which:

BRIEF DESCRIPTION OF THE DRAWINGS

FIG. 5 is a conceptual graph showing determination of pen banding factor (PBF) by interpolation from three values that have the highest image quality factors (IQF);

FIG. 6 is a like graph showing PBF determination by extrapolation from three values with highest IQF;

FIG. 7 is a dual flow chart, very schematic, showing primary differences between earlier procedures and the present invention;

FIG. 18 is a highly schematic diagram of the working system of the FIG. 16 and 17 printer, as used to practice preferred embodiments of the invention.

DETAILED DESCRIPTION OF THE PREFERRED EMBODIMENTS

1. Relationship to the Prior Art

Figure 1:
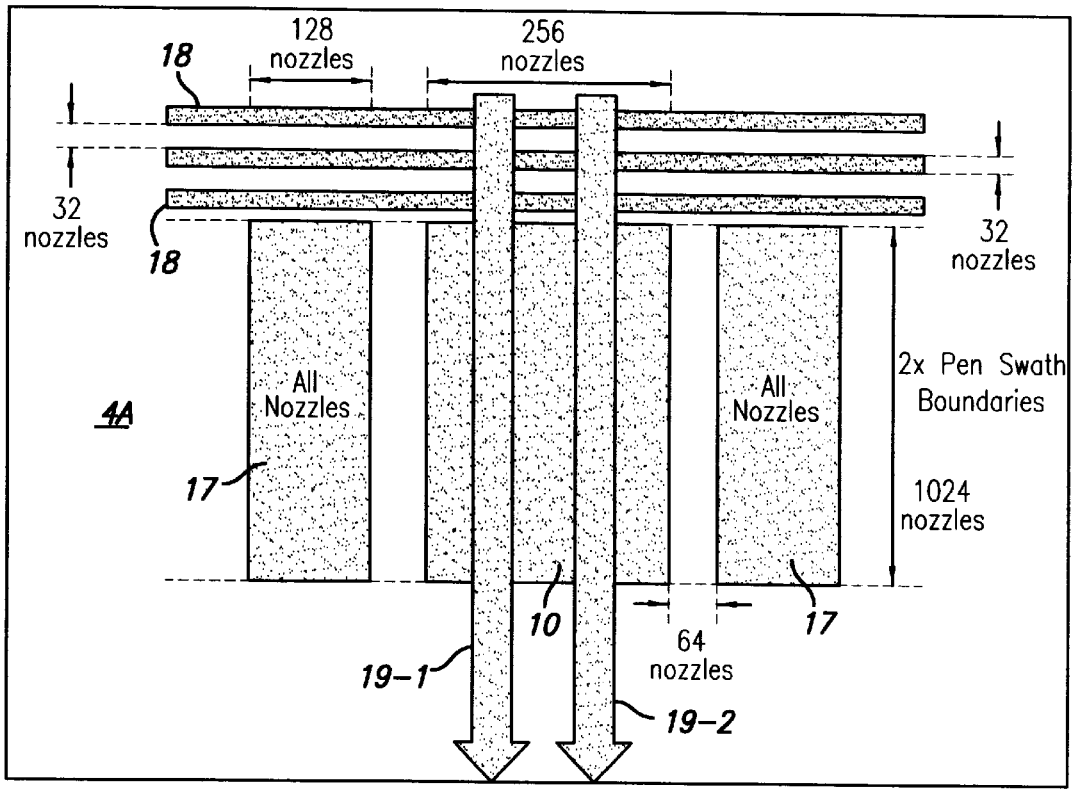
FIG. 1 is a diagram of a basic test pattern for a single pen and single color, printed on a printing medium.

Several different quantitative approaches to the determination of print-medium advance are discussed in a descriptive way—i.e., in words—in the earlier "BACKGROUND" section of this document. Analogously, the procedures of the present invention too have been presented above in mainly a descriptive way, in the separate section of this document entitled "SUMMARY OF THE DISCLOSURE".

That summary section did also include algorithms corresponding to some of the procedures of the present invention. In the summary section, however, the algorithms were only displayed, unaccompanied by graphical illustrations—or by discussion based on illustrations.

In this present section, some of those same earlier approaches and also most of the procedures of the present invention will be presented together in a mathematical form—that is, as algorithms—and in some cases with graphical aids to understanding. In this section, however, the order of presentation will not be chronological but rather will proceed in a progression that is considered somewhat more logical mathematically.

It is hoped that by setting out the old and new procedures thus in a mathematical or algorithmic format, and placed in order on a mathematical rather than historical basis, this section will make more clear the relationships between the invention and the art. Thus the methods known heretofore are represented below in nonconsecutive subsections 6(a), 6(b), and 6(e); and the methods of the present invention in nonconsecutive subsections 6(c), 6(d) and 6(f).

First, however, a general introduction to the philosophy of the present invention is presented in subsection (2) below, followed in subsection (3) by test-pattern and measurement details of the present invention, and then in subsection (4) by a very brief comparison of an earlier approach and the present invention, and in subsection (5) by a general mathematical formulation of advance-compensation procedures. The above-mentioned algorithms of subsection (6) are used by inserting them into the general formulation of subsection (5).

2. Orientation

Pens exhibit various paper-axis directionality ("PAD") profiles that can cause banding. A slight adjustment in the printing-medium advance stroke, however, can oftentimes decrease banding and thereby improve image quality.

The challenge is to determine an optimum advance that maximizes the quality, particularly in a multipen (e.g. sixpen) system when each pen has a unique PAD profile. Historically a "PAD factor", or pen swath-height, measurement was made from the pen alignment pattern.

In more modern products, however, due to the problems outlined in the "BACKGROUND" section of this document, the emphases on pen length and swath height have both been set aside in favor of a focus upon determining an optimum advance and an associated pen banding factor (PBF) for each colorant—i.e. for each pen. These new approaches measure neither pen length nor printed swath height, but instead determine what print-medium advance value produces best quality of a printed area fill (or some other image element, as taught by Cluet).

Once the PBFs have been determined they can be inserted into any one of several different algorithms. Some of the algorithms weigh the relative importance of the several pens to determine the overall optimum advance for each swath; other algorithms do not.

Algorithms can be classified as fixed advance, in which the printing medium is advanced by a constant distance for every swath; or as variable advance, in which the medium moves by various distances in successive swaths. In the variable-advance case the distance may be varied in an entirely preset manner, or under control of a randomization or pseudorandomization protocol, or may be influenced by image content.

Distance may instead be varied in combinations of these several ways. In general, the variable-advance algorithms are expected to provide superior banding performance, though outlier pens may degrade the overall image quality.

PAD compensation is intended to improve image quality, particularly in systems having multiple pens—for instance, six pens. In practice, what can matter most are interactions between the selected algorithm and the specific combination of specific pens present.

Different quality tradeoffs apply to different specific combinations of specific pens. Each possible combination of pens with relatively inferior and superior PAD profiles interacts differently with each available algorithm, and unfortunately the pen combinations cannot be known when a product is shipped from a factory or acquired by an end-user.

Nevertheless, each time an advance stroke is called for, a printer can only perform a stroke of one single length!—and it can do so only in response to just one single algorithm. Therefore it is essential to devise an algorithm that does the best possible job of optimizing image quality regardless of the pens used.

A compensation algorithm should not improve the performance of a single poor pen at great cost to performance of other pens that are better, or at least not without informing the user (or helping the user to see) that this is being done. The user preferably is made able to implicate a particular pen as a main cause of banding, and to decide whether to replace that pen—rather than being left to believe that the banding quality of the overall printing system is poor.

The procedures discussed below should be performed each time any of the pens is replaced. It should also be performed periodically, since nozzles age in several different ways; and also whenever observation of printed images gives cause to believe that image quality has changed—whether for worse or better, since even improvements may suggest that recalibration may provide better quality yet.

3. Test Pattern and Pen-Banding-Factor Measurements

The basic pattern, for a particular product of the Hewlett Packard Company, is preferably an area fill 10 (FIG. 1) printed on a printing medium 4A, in a particular color of interest. Rendition is performed by error diffusion—which is the algorithm incorporated in the standard internal Postscript® raster image processor (RIP).

Figure 3:
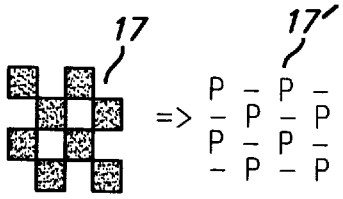
FIG. 3 is a like diagram showing pixel structure of so-called "spitting" areas in the FIG. 1 basic pattern.

The eight-pass bidirectional mode is the standard photograph-quality procedure in the product, and it is used with all the available compensations activated. To maximize the likelihood of firing all the nozzles, the test pattern also includes so-called "warming and prespitting" areas 17 (FIGS. 1 and 3).

These are printed at fifty percent density, but built up in successive passes from checkerboard patterns 17' for the particular color. As shown (FIG. 1), the area fill and the warming and prespitting areas in common are advantageously 1,024 nozzle rows tall. The warming and prespitting areas are spaced to left and right from the area fill by the equivalent of 64 nozzle rows (but horizontally). The area fill is the equivalent of 256 nozzle rows wide; and each warming and prespitting area, 128 rows.

Figure 2:
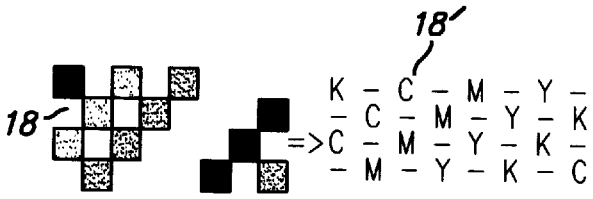
FIG. 2 is a like diagram, but greatly enlarged to show pixel structure of reference-line areas in the FIG. 1 basic pattern.

In addition, horizontal reference lines 18 are printed in all four of the full-strength colors CMYK, using a repeating pattern that calls for pixels 18' (FIG. 2) in all of the undiluted colors KCMY. This procedure makes the measurement more resistant to the effects of misaimed and nonfunctioning nozzles. Preferably three reference lines are printed above the area-fill/warming-and-prespitting pattern; the thickness (i.e. height) of each line is the equivalent of 32 nozzle rows, and the lines are spaced apart by that same distance.

This basic pattern is not printed in a single pass but rather in an overlapping-multipass procedure, with a generally corresponding multiple number of printing-medium advances between passes. (In some cases, an advance does not necessarily follow each pass.)

After printing, the pattern is scanned twice along two spaced apart paths 19-1, 19-2. This strategy avoids undue response to possible small defects, dust spots etc. in the pattern.

In practice the pattern is not printed with a single value of printing-medium advance, or for a single color in isolation, but rather at each of several different advance distances A, B, C, D, E (FIG. 4) in turn—and making adjacent different-color printed arrays 11 through 16, 21 through 26, . . . , 51 through 56, with each of the typically six (or four) pens in the system, respectively. The fill pattern is printed (see bottom of FIG. 4) at sixty-percent density for black (K), standard cyan (C) and standard magenta (M); and forty percent for yellow (Y); and ninety percent for light magenta (m) and light cyan (c).

These values were selected through an experiment to determine which area-fill tones were most sensitive to banding in the product, in an eight-pass bidirectional print-mode. Observer-perception results were fifty to sixty percent for K, sixty to seventy for C and M, forty percent and ninety percent for Y, and eighty to ninety percent for c and m. (With respect to Y, one cluster of observer results pointed to forty percent as the most-sensitive tone; and a separate cluster, to ninety percent.)

Figure 4:
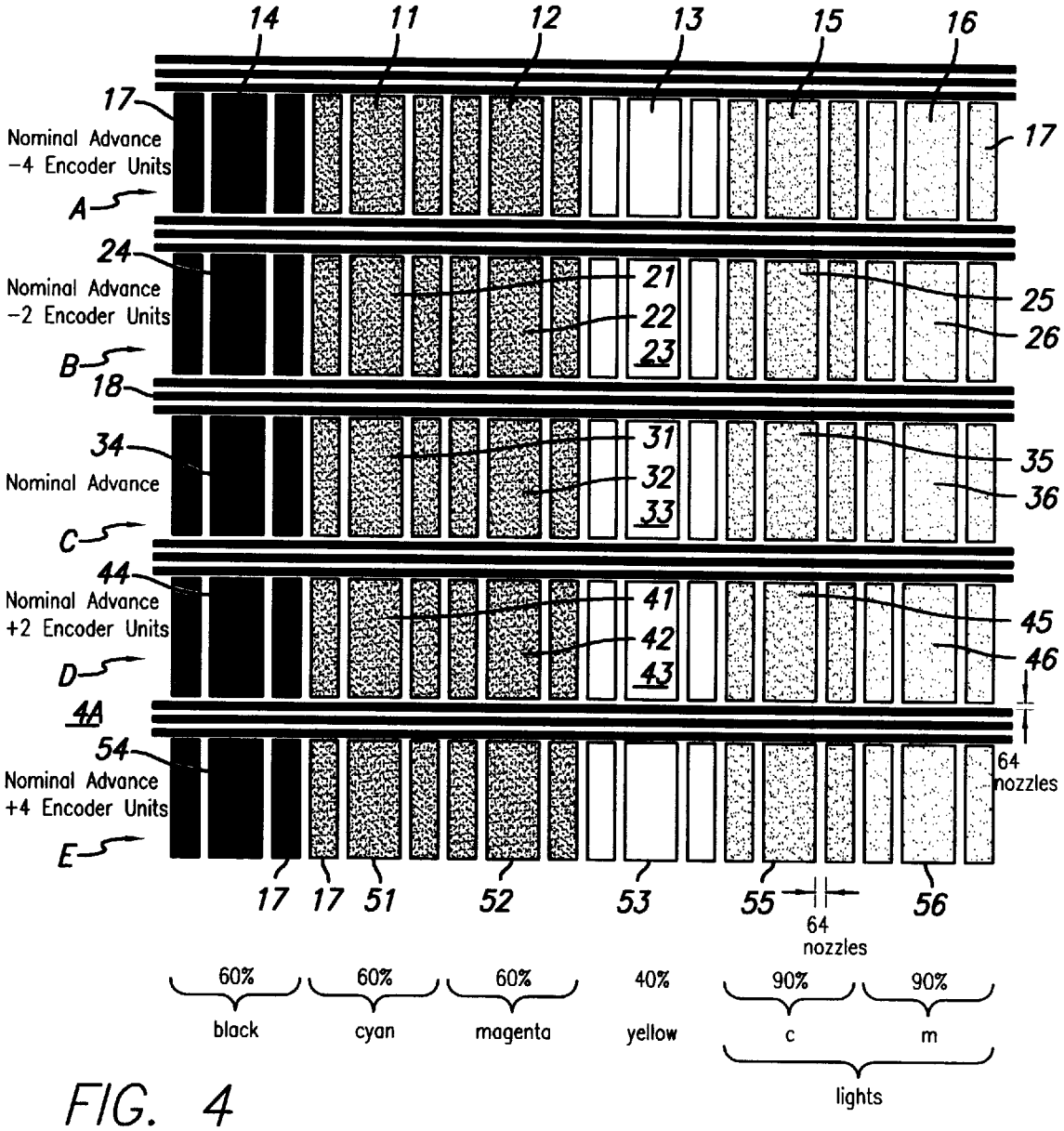
FIG. 4 is a diagram like FIG. 1 but with the basic pattern replicated for multiple pens (and colors) and also for respective multiple different printing-medium advance strokes.

As in the basic, general pattern of FIG. 1, the full pattern of FIG. 4 shows the warming and prespitting areas 17 and the reference lines 18. The spacings too are as illustrated in FIG. 1.

FIGS. 1 through 4 do not show graphically the different advance values or the possibly different pen heights. To make this more clear, FIG. 4A has been copied here from the above-mentioned Cluet document.

Figure 4A:
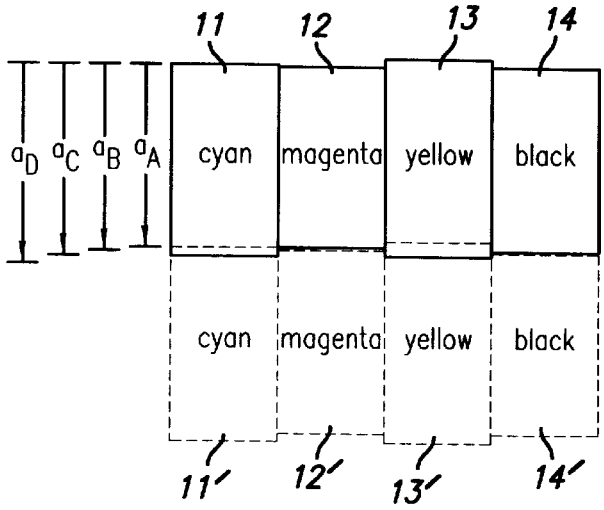
FIGS. 4A thru 4D are simplified versions (copied from the above-mentioned Cluet document) of FIG. 4 showing fewer pens, and without the reference-line and spitting areas—but more explicitly showing the multiple different advance strokes.
Figure 4C:
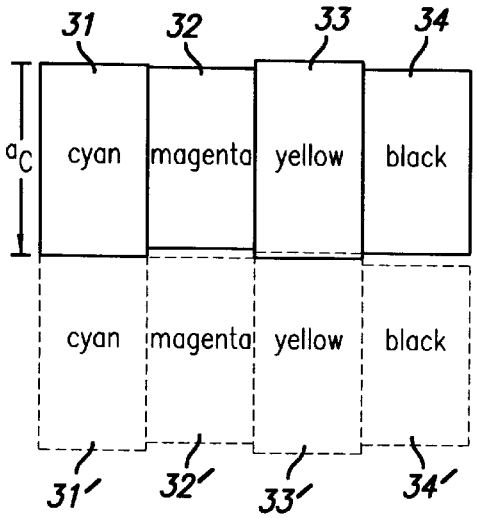
Figure 4B:
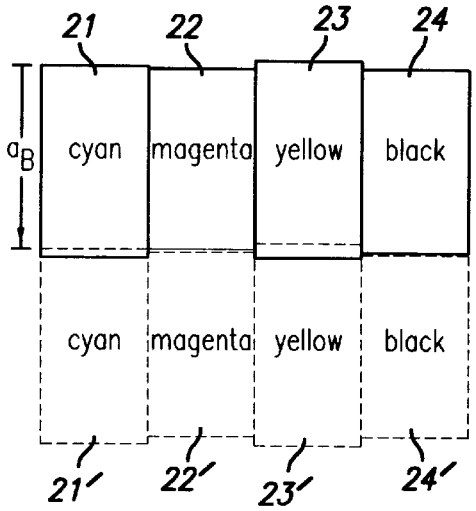
Figure 4D:
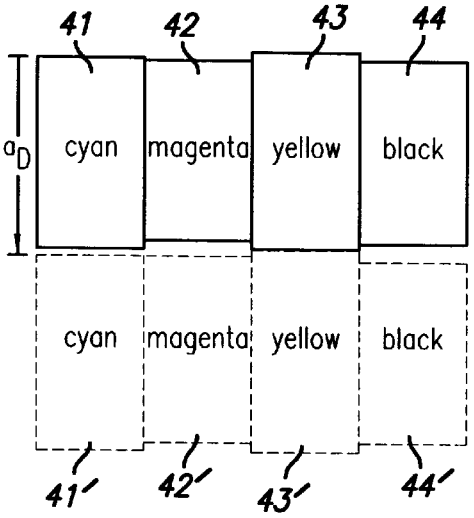

Relative to FIG. 4, the Cluet drawing FIG. 4A is very greatly simplified, showing for each advance-stroke setting only two successive scans in a single-pass mode (no overlapping subswaths); and also showing only four different advance strokes A–D rather than five. Nevertheless FIG. 4A is helpful in that it shows different advance values $a_A$, $a_B$, $a_C$ and $a_D$ for the four different stroke examples.

Since the pen heights are the same in all four sets, the results of the different advance strokes are plainly visible. They range from conspicuous overlap in the "A" set to conspicuous failure of abutment in the "D" set.

The overall procedure begins with printing of the measurement pattern, using the specified printmode. Actually with the eight-pass bidirectional mode there are five possible settings of paper advance, so actually the test pattern is the same plot printed five times with those different paper-advance settings.

Next the pattern is scanned and processed, and an image quality factor (IQF) $Q_i$ found for each pen i and for each advance-value tile or patch. This is done generally as in the previously mentioned Cluet document, but with measurement stages, computational stages and subjective ranking stages all cooperating to produce the overall IQF values—and then finally their correlation with the amount of PAD error present.

The measurements produce, for each pen i, raw signal-level data $L_i$ (y) that are objective representations of reflectivity in the printed patterns as a function of distance along the printing-medium advance axis y. (Note, L here is simply signal level, not L*a*b* lightness.) From these data in turn, computation derives metrics, or measures, of the nonuniformity as such in each $L_i$ (y) data set.

Subjective observation and ranking of many banding samples produce indicators of goodness—i.e. of overall image quality. These subjective indicators are then preliminarily correlated with the objective machine-generated nonuniformity metrics, for the same set of banding samples, so that the metrics thereafter can be confidently substituted for new subjective observations of goodness.

As to computations, it has been found helpful to filter the data $L_i$ (y) from the pattern scans to provide particular sensitivity to the kinds of banding that are most prevalent. These are generally in two spatial-frequency ranges: one component at relatively high frequency, namely the reciprocal of the number of passes; and another at relatively low frequency, namely one-half that reciprocal. These may be denominated as a fundamental wavenumber and a subharmonic wavenumber, $1/\lambda_F$ and $1/\lambda_S$ respectively.

This requires setting two bandpass filters, one of which may be expressed—normalizing to the number of nozzles in the pen—as follows, with values for a typical example $$\frac{1}{\lambda_F} = \frac{\text{number of passes in the mode}}{\text{number of nozzles in the pen}} = \frac{8}{512} = 1/64$$

and another at relatively low frequency, with the same ratio equal instead to $1/\lambda_S$=1/128. These values in decimal form are $1/\lambda_F$=0.016 and $1/\lambda_S$=0.008. The filters are desired to be symmetrical in spectra; hence a common bandpass extremum is placed at the center.

A Hamming window is advantageously used, to minimize the windowing effect in the samples. The exemplary values stated above apply to a current product that uses error-diffusion, error-hiding masks, a 24 dot/mm (600 dpi) pen of length about 20½ mm (0.853 inch), and the bidirectional eight-pass printmode discussed above.

In implementing this strategy of matching the prevalent components of the banding, it is helpful to obtain an absolute-black response value for the system—in effect a dark-current signal level, that is acquired with the sensor or sensors turned on but positioned over a hole, for example parked in the service station. This response is advantageously subtracted out before further analysis to effect a relative "Lab" color-space conversion.

It is also helpful to locate the centers of the lines in the test pattern. Processing to obtain the so-called "relative Lab" values in essence expresses the input data in terms of paper-white-relative b* for yellow, and L* for the other colors.

The inventors refer to this dual relative space as "rL & rb". These magnitudes are proportional to the true L* and b*; and this transformation thus has the benefit of making the sensor sensitivity parallel human sensitivity.

These rL & rb signals will be processed to yield the different banding magnitudes and granularity that finally will be entered as parameters into a model for estimation of image-quality level. The model is generated by an image-quality assessment test (IQAT) experiment.

Patches are advantageously windowed for analysis, using the line centers as reference to easily synchronize two scans—taken in different positions—for each pattern. For instance where the total length of a patch is 1,204 dot rows and the final length of interest is the pen height of 512 dot rows, the difference (692 rows) is available for margins.

A suitable margin for avoiding edge effects may be 256 dot rows total (the line sensor itself is a low-pass filter, with a sensitive area that can be up to sixty dots). The remainder is then more than adequate to serve as a necessary margin for the Fourier filters—which should be the larger of the lengths needed for each of the two filters, e.g. 255 dots.

The windowed filter outputs may be identified as fundamental and subharmonic components $L_{iF}$ (y) and $L_{iS}$ (y) of the sensed data levels. A third component $L_{iG}$ (y) representing granularity is also advantageously recognized.

Regression lines are then found for each patch and removed—i.e., deducting out the systematic behavior, so that all that remains is the variation. It is adequate to employ a conventional approach although optimized procedures may be straightforwardly developed by a competent programmer to enhance robustness.

Figure 12:
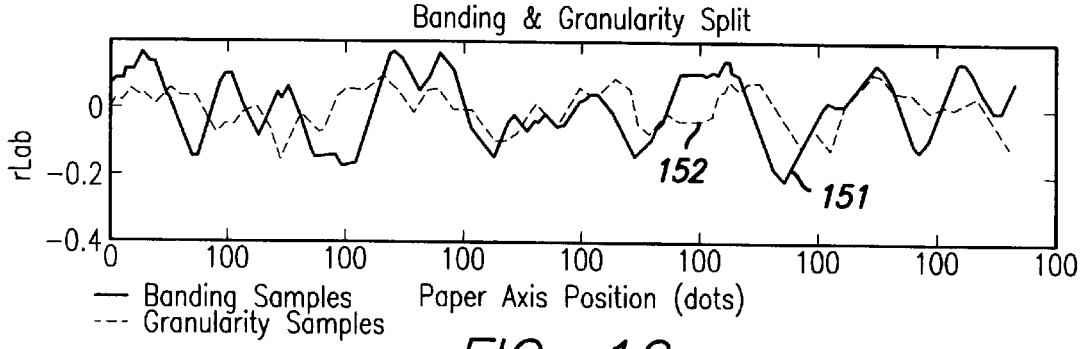
FIG. 12 is a two-dimensional graph showing exemplary banding and granularity samples.
Figure 13:
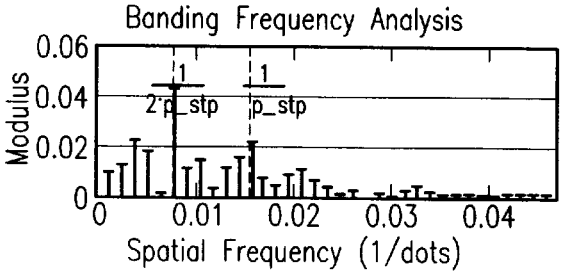
FIG. 13 is a two-dimensional spectral bar graph showing frequency content of banding.
Figure 14:
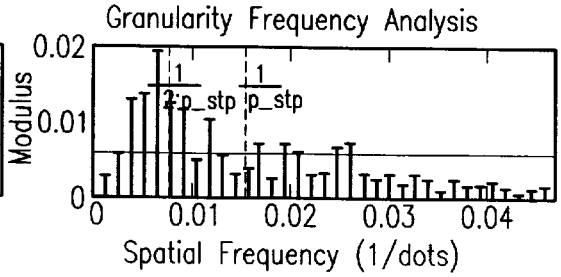
FIG. 14 is a like graph but for frequency content of granularity.

Banding samples 151 (FIG. 12) and granularity samples 152 can then be obtained, and typically appear as shown for banding—both frequency components $L_{iF}$ (y), $L_{iS}$ (y) considered together, as the solid curve—and granularity $L_{iG}$ (y). Spectral distributions for both are presented in FIGS. 13 and 14 respectively.

Figure 15:
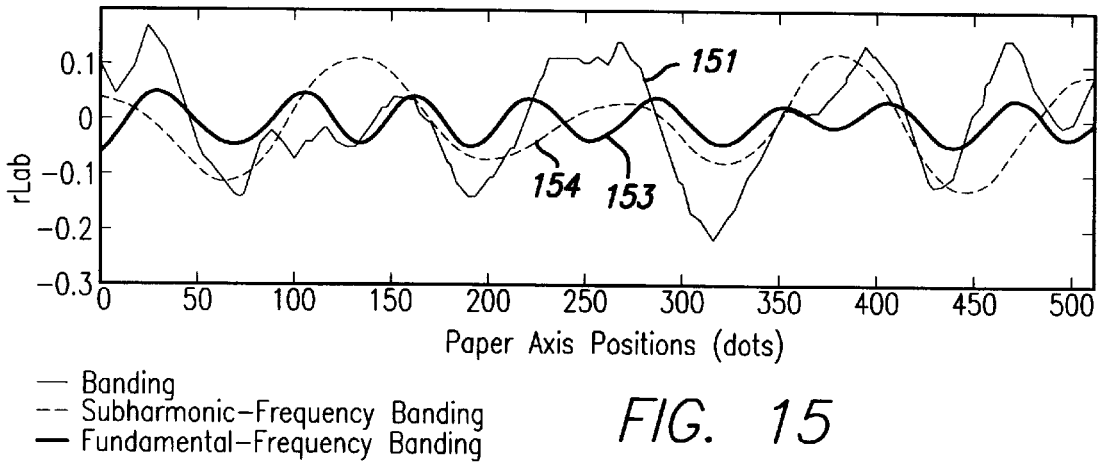
FIG. 15 is a graph like FIG. 12 but for banding only, and with the two main components broken out separately.

From these data, the two previously mentioned spatial-frequency components $L_{iF}$ (y), $L_{iS}$ (y) of banding can be extracted by applying the FIR filters—and the edge effect (in the first 255 samples) due to the filter. Typical results are illustrated for these banding components 153, 154 respectively (FIG. 15).

Remembering that an objective is to find some measure of nonuniformity in the scanned signal, a suitable output is the standard deviation $\sigma_F$, $\sigma_S$, $\sigma_G$ for the sampled banding $L_F$, $L_S$—in each of the spatial-frequency ranges $1/\lambda_F$ and $1/\lambda_S$ respectively—and also for granularity $L_G$. For each of these parameters the deviations are calculated in a usual way, $$\sigma_C = \sqrt{\frac{2}{\text{length}(L_C) - 1} \sum_{C=F}^{G} (L_C - \mu_C)^2}$$

where C=the component F, S or G $L_C$=the amplitude for that component $\mu_C$=the mean amplitude for that component.

(As throughout the foregoing development, the parameter L here advantageously represents signal level or a relative lightness derived from it, not strictly lightness.) Note that the set of metrics "$\sigma_F$", $\sigma_S$, $\sigma_G$ includes no parameter (such as "$\sigma_L$" or "$\sigma_{L^*}$") for overall variation in the lightness dimension of L*a*b* space, since lightness has little effect in this procedure; and no variation value (such as "$\sigma_{GLOBAL}$") for banding in general, i.e. global banding, which is redundant with the two spatial-frequency metrics $\sigma_F$, $\sigma_S$.

With the main metrics defined as above, it is desirable next to use them in building a model which can produce for each pen i a respective single IQF number $Q_i$ expressing the area-fill uniformity quality. This numeric allows ranking of different samples in a one-dimensional sequence from best to worst.

To build such a model, it is desirable first to perform the earlier-mentioned IQAT experiment to correlate the different objective metrics $\sigma_F$, $\sigma_S$, $\sigma_G$ with subjective human perceptions of corresponding banding samples. This experiment ideally begins with a wide range of samples for each primary color.

Provision of enough levels of banding in both types, with levels distributed along the range more or less uniformly, is important. To ensure such adequate sampling, it is advisable to print with many different pens and then make an intelligent visual examination—to be certain that the number and distribution of samples is sufficient to feed into the IQAT experiment.

After selection of the samples that should go into the experiment, they are all scanned and their metrics determined. The IQAT experiment itself consists of showing human observers the samples and asking them to order them in terms of area-fill uniformity quality.

Averaging or otherwise combining the responses from all the observers should yield a valid ordering for all the samples. This is true even though, as mentioned previously, some seemingly anomalous split returns have been noted as e.g. for Y. Possibly these split returns may represent actual characteristics of human subpopulations with respect to native color vision, or spatial-frequency sensitivity, etc.

Given this ordering and all the metrics, the next step is to build the model that is to interrelate them. What is sought is a model that will provide, for each color, an IQF value $Q_i$ which expresses the quality for the color sample.

Any of a great variety of models can be used, including a simple linear one—which the present inventors have found satisfactory. If variation in lightness L* is included in the metrics set, that simple linear model appears thus:

$$Q_i = a\sigma_L + b\sigma_G + c\sigma_F + d\sigma_S + e.$$

For a standard black pen in a current product of the Hewlett Packard Company, the fitted constants were:

a=−0.30898
b=5.2817085
c=−12.35731
d=−5.9338955
e=21.34711 and the overall adjusted least-squares regression measure $R^2$ is 89.5%. Of course all these numbers will vary for different pen types as well as different colors; indeed it cannot be guaranteed even that a linear model will suffice for all kinds of pens or for all colors, in general for any printer product.

Once the IQF values $Q_i$ (for each color i) are available, each is mapped with its associated pen banding factor (PBF), $f_1$. These are defined as $f_1 \equiv \Delta A_i / A_O$, in which $\Delta A_i$ is—for pen i—a respective one of the advance increments shown in FIG. 4 (namely −4, −2, 0, +2 or +4 print-medium encoder counts for the eight-pass mode); and $A_O$ is the nominal advance of 2000 encoder counts.

Based upon these mappings or functional relationships $Q_i$ ($f_i$), the next step is to determine the optimum PBF $f_i$ for each pen. Two alternative approaches are acceptable, the first being somewhat preferred as slightly faster—and the second being somewhat preferred for its greater accuracy.

The first is a discrete approach: for each pen, the banding factor $f_i$ chosen is simply that 163 (FIG. 5) or 174 (FIG. 6) which has the highest quality factor $Q_i$. The second is a continuous approach: starting with the PBF that provides maximum IQF, that PBF value is used with its two nearest neighbors 162, 164 or 172, 173, respectively to fit a second-order polynomial (or other suitable function) 161 or 171 and so reach the maximum IQF 165 or 175 attainable by the system.

Thus an appropriate function $Q=a\cdot f^2+b\cdot f+c$ can be fitted to three points in IQF-PBF space (Q-f space), and a maximum 165, 175 (or minimum!) found by the familiar condition for a zero first derivative—i.e. from the solution to the equation $Q=-f/2a$. That ideal condition may be between two of those IQF values, representing an interpolation (FIG. 5); or in principle may be above or below all three of the values 172, 173, 174, representing an extrapolation (FIG. 6).

The latter condition, however, is quite undesirable: it suggests that the product design has never been optimized, since the five standard advance increment values ΔA fail to bracket the overall optimum increment ΔA for the entire set of pens. In any event, it is important to begin with the highest IQF, lest the zero-slope condition found turn out to be a minimum rather than a maximum.

Given the three measured points $(f_1,Q_1)$, $(f_2,Q_2)$, $(f_3,Q_3)$, elementary matrix algebra yields the final solution from $Q=-f/2a$ using the determinant D and coefficients a, b and c as follows.

$$D=(f_1f_2-f_1f_3-f_3f_2+f_3^2)\cdot(f_1-f_2)$$

$$a=[(f_3-f_1)Q_2)+(Q_1-Q_3)f_2+(f_1Q_3-Q_1f_3)]/D$$

$$b=[(f_1^2-f_3^2)Q_2)+(-Q_1+Q_3)f_2^2+(Q_1f_3^2-f_1^2Q_3)]/D$$

$$c=[(f_1^2f_3-f_3^2f_1)Q_2+(-f_1Q_3+Q_1f_3)f_2^2+(f_1^2Q_3-Q_1f_3^2)f_2]/D$$

In the interpolation case, the system must be able to make use of the results by splitting the difference, as for example by selecting an overall compensation increment ΔA=+3 encoder units if the ideal value is found to be between +2 and +4. In the extrapolation case, to implement the results the system must be capable of adopting an advance increment value that extends the Q=Q(f) scale to f values higher or lower than used in the measurement—for example by setting the overall increment ΔA=−6 units when the ideal value is found to be −4.

Before the present invention was first broached, the required compensation value in a particular product line had apparently stabilized. Based upon this apparent stabilization, production engineering personnel had proposed to fix the PAD compensation value (i.e. increment value) ΔA, rather than providing several selectable advance increments ΔA. The proposed fixed increment value was −1 encoder unit.

Fortunately, however, the selectable advance was preserved. Six months later the prevalent increment value had drifted to +1 unit.

4. Paper-Axis Directionality Compensation, General

In a prior printing-medium advance scheme, the writing system nominal advance 111 (FIG. 7) was corrected by a PAD compensation procedure 112 through 118 that was based upon measured swath heights for the several individual pens. This measurement 112 did not segregate media effects—i.e. primarily the effect of printing-medium thickness.

The overall advance increment $\Delta A$ selected by the system was calculated from a weighted mean of the individual-pen swath heights, weighting the individual heights in proportion to the number of inkdrops fired by each pen in a previous swath. This system is discussed further in section 6(e) below.

The swath-height optimized advance value 115 was forwarded to a paper-advance calibration stage 116, which in turn provided a corrected mechanical advance value 117 to operate the final motor advance stage 118.

In a current printing-medium advance scheme 121 through 128 employing the present invention, the writing system is instead corrected by a PAD compensation procedure that is based upon directly measured dependence of banding on advance value 122, 123, rather than measured swath height. Furthermore the effects of print-medium variation (primarily thickness) are segregated into a separate "media factor" adjustment stage 124, 125.

The optimization of advance for, simultaneously, both media and pens was feasible in the earlier scheme because swath-height error in each pen was reasonably linear with position along the pen. In a corresponding present product the pens lack such a degree of linearity, and the present invention accordingly calls for separated compensation of pen plus writing system in the earlier "PAD compensation" stage, and media effects in the later "media-factor compensation" stage.

5. Paper-axis Directionality, Algorithms

In the following section 6, specific strategies will be presented for, in effect, relating measured ideal advance increments $\Delta A_i$ for each pen to just one single overall best advance increment $\Delta A$ for the entire set of pens. (As will be seen, this relationship is more conveniently expressed in terms of pen banding factors $f_i$ rather than increments $\Delta A$; as indicated earlier these two are interrelated as $f_1 \equiv 1+\Delta A_i/A_O$.)

Before proceeding to those specific relations, however, this present section will develop a general expression—into which those relations can be inserted—for actual motor advance $A_M$. required to produce a compensated, correct printing-medium advance $A_P$.

This presentation begins with definitions:

$A_P \equiv$desired paper advance $A_M$=actual motor advance (from implicit zero positions)

$X_{P0}$=initial paper position $X_{M0}$=initial motor position $X_{P1}$=final paper position $X_{P1}$=final motor position errors in $A_P$ ($A_M$):

$e_0$=cyclical error e (FIG. 8) at original position $e_1$=cyclical error at final position E=noncyclical error (FIG. 8), i.e. mean error k=slope of E for the print medium in use $k_0$=same for a standard, reference medium $$\underline{F} = \text{the "media factor"}, F \equiv \frac{1-k_0}{1-k}.$$

$f_1$=pen banding factor (PBF) for pen number i or color CMYKcm (c, m being "light" inks)

Figure 8:
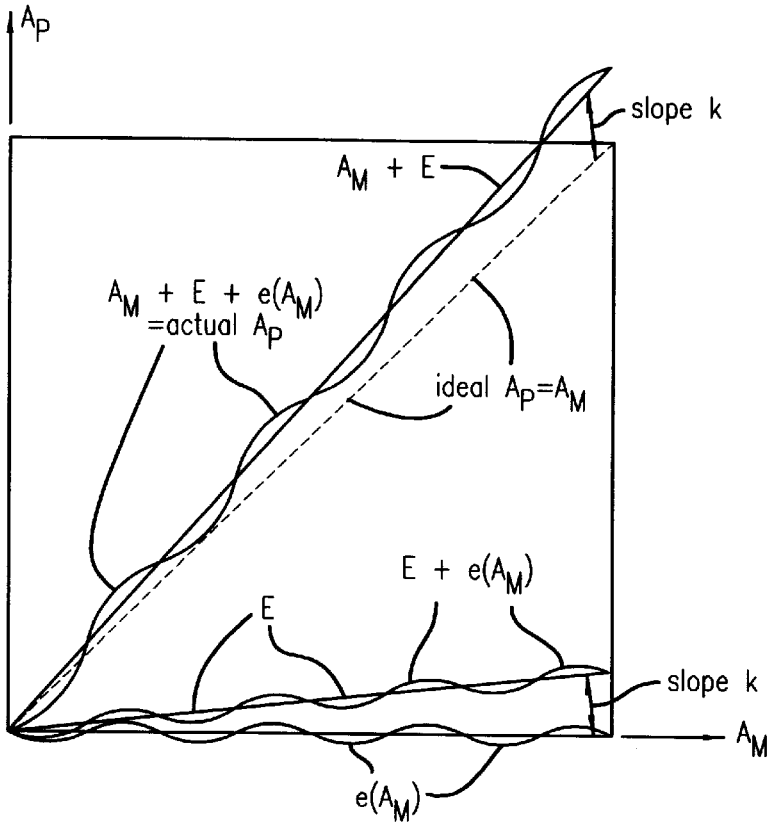
FIG. 8 is a two-dimensional graph showing relationships between different error components of printing-medium advance as a function of motor advance.

The physical significance of these parameters may be appreciated more readily from FIG. 8, showing for reference a kind of idealized relationship: "ideal $A_P=A_M$"—that is, a condition in which the print-medium advance $A_P$ and motor advance $A_M$ are exactly the same.

As the drawing also shows, two kinds of errors cause departure from this ideal. The cyclical (sinusoidal) error e expectably derives from eccentricity in gears and other rotating parts in the printer mechanism.

The noncyclical part E, also called the "mean error" as it may be constructed down the center of the cyclical trace e, is due largely—but in general not exclusively—to the thickness of the printing medium. (This means that the ideal $A_P=A_M$ corresponds to infinitesimally thin printing media and cyclically perfect mechanical parts.) Thus the print-medium "actual $A_P$" is the motor advance $A_M$ adjusted by the mean error E and, superposed on that mean error, the cyclical error e.

With this guidance in mind, a more-formal presentation of relationships follows:

$$\underline{x}_{M0} - \underline{x}_{p0} = \underline{e}_0 + \underline{k}\ \underline{x}_{M0} \Longrightarrow \underline{x}_{P0} = \underline{x}_{M0} - \underline{e}_0 - \underline{k}\ \underline{x}_{M0}$$

$$\underline{x}_{M1} - \underline{x}_{p1} = \underline{e}_1 + \underline{k}\ \underline{x}_{M1} \Longrightarrow \underline{x}_{P1} = \underline{x}_{M1} - \underline{e}_1 - \underline{k}\ \underline{x}_{M1}$$

$$\underline{A}_p \equiv \underline{x}_{p1} - \underline{x}_{p0} = \underline{A}_M(1-\underline{k}) + (\underline{e}_0 - \underline{e}_1)$$

$$\therefore A_M = \frac{A_P - e_0 + e_1}{1-k} \text{ is the ideal compensation;}$$

or allowing for different media $$A_M = \frac{A_P - e_0 + e_1}{1-k} \cdot F.$$

To implement a desired motor advance that takes account of the measured PBF values $f_i$ the paper advance $A_P$ in this formula must now be expressed in terms of these $f_i$ values—but there are many possible relationships between these values and the advance $A_P$. For the general case, $A_P$ can simply be shown as a function of all the PBF values $f_i$ that are operative, i.e.—$A_P \equiv A_P(f_i|_{all\ i})$, so that the new general compensation scheme is $$A_M = \frac{A_P(f_i|_{all\ i}) - e_0 + e_1}{1-k} \cdot F$$

and the actual dependence of $A_P$ on the PBF values $f_i$ is found from the measured $f_i$ by any of several alternative compensation algorithms—particularly, but not necessarily, including those discussed below.

6. Pen Banding Factor Algorithms (a) None (fixed advance; no compensation)—This algorithm is in essence a null procedure, as the paper advance $A_P$ is simply a nominal constant $A_O$; or in other words there is no dependence at all upon the banding factors $f_i$:

$$A_P(f_i|_{all\ i}) \equiv A_O$$

This trivial "algorithm" corresponds to industry practice before introduction of pens with significant PAD error. For the longer and less accurately aimed modern pens, it yields an accurate, constant page size each time it is used—but at the expense of image quality.

(b) Arbitrarily-weighted mean (fixed advance)—This algorithm advances the printing medium using a weighted mean PBF, $f_{MW}$, calculated from the individual PBF values $f_i$, 131 through 136 (FIG. 9), for the entire set of pens:

$$A_P(f_i|_{all\ i}) \equiv A_O f_{MW} = A_O \frac{\sum W_i f_i}{\sum W_i}.$$

Figure 9:
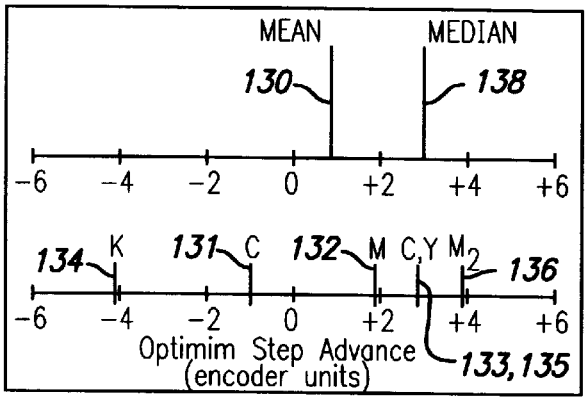
FIG. 9 is a pair of one-dimensional graphs showing derivation of two different types (mean and median, respectively) of fixed printing-medium advance, based upon individual optimum advances for six different pens.

Here $W_i$ is a weight, from zero through unity, for pen i. The fixed mean is rounded down to a nominal mean value 130 at the nearest encoder unit, e.g. to +1 (FIG. 9).

The weights $W_i$ are selected based upon a priori knowledge about the importance of the corresponding colors, with regard to banding. Thus for example light (dilute) colorants and yellow most typically contribute least to conspicuous banding and accordingly may be assigned low weights, such as for example values between 0.2 and 0.4.

This algorithm yields a page size potentially different from that specified in the source application program, but the page size will be constant for a given set of pens. A small improvement in image quality can be expected with this algorithm.

A pen 134 (FIG. 9) whose PBF is a statistical outlier, however, very importantly degrades the overall image quality—as does for example the black pen K with PBF of −4. Furthermore, because that particular PBF strongly attracts the mean toward itself, the identity of the outlier pen is not very conspicuous from the color banding behavior seen in an image.

A user who tries to troubleshoot the system visually, by evaluating the colors associated with the worst of the banding, therefore encounters some difficulty in isolating the worst contributor to the banding. This effect is undesirable, because a significant banding improvement could otherwise be achieved merely by replacing just that one pen 134.

(c) Normal distribution (variable advance)—Here the printing medium is advanced by values that vary, and preferably in a randomized way, from stroke to stroke. This novel algorithm is analogous to the arbitrarily-weighted-mean procedure, above, but here the output values vary:

$$A_P(f_1|_{all\ 1}) \equiv$$

$$A_O \cdot \mathrm{NORMAL}[f_M(\mathrm{rand}),$$

$$\sigma_f]$$

with the distribution truncated to the lower and upper PBF values, where $$\mathrm{NORMAL} \equiv \mu + \frac{\sigma}{2}\sqrt{-\sigma^2 \cdot \ln[rand(1)]} \cdot \cos[2\pi\ rand(1)]$$

$\sigma \equiv \sigma_f$, standard deviation of all $f_1$ $$\mu \equiv f_M \equiv \frac{\sum_{i=1}^{N} f_i}{N},$$

N≡number of pens, maximum value of i rand (x)≡a function that generates uniformly distributed random numbers from 0 through x $$\mathrm{NORMAL} \equiv f_M + \frac{\sigma_f}{2}\sqrt{-\sigma_f^2 \cdot \ln[rand(1)]} \cdot \cos[2\pi\ rand(1)]$$

so $$A_P \equiv A_O\left(f_M + \frac{\sigma_f}{2}\sqrt{-\sigma_f^2 \cdot \ln[rand(1)]} \cdot \cos[2\pi\ rand(1)]\right)$$

(truncated as mentioned above).

Note that $\mu \equiv f_M$ as before is the mean PBF 130, and σ the standard sampled deviation of all the PBF values 131 through 136 for the several pens present.

The function "rand", parametrically represented as rand (x), generates uniformly distributed random numbers (not shown) between zero and x; for present purposes x is fixed at unity, i.e. rand=rand(1). A sequence of these uniformly distributed random numbers is thus fed into the composite function NORMAL[$f_M$(rand), σ]—which responds with a randomly varying sequence of values, but within a normal-distribution envelope (FIG. 10), based upon the same input optimum advance values 131 through 136 for the individual pens.

This algorithm yields inaccurate and varying page sizes. To improve page accuracy, the standard PostScript® feature of a commercial printer product can scale the page size, using the calculated mean advance—as described, for instance, in the previously mentioned document of Donovan and Boleda. The printed page sizes are then very close, but not exactly equal, to that specified in the application program.

(d) Median (fixed)—This novel algorithm too is analogous to the weighted-mean procedure in subsection (b) above, but the median banding factor $f_E$ (rounded up to a value 138 at the nearest encoder unit) is used instead of the mean:

$$A_P(f_E) \equiv A_O f_E$$

$$f_E \equiv \frac{1}{2}\left(f_{\frac{N}{2}} + f_{\frac{N}{2}+1}\right), \text{ for } N \text{ even}$$

$$f_E \equiv f_{\frac{N+1}{2}} \text{ for } N \text{ odd}$$

Figure 10:
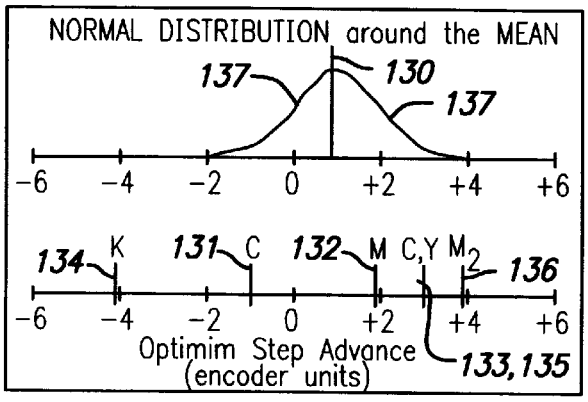
FIG. 10 is a like illustration but for a variable advance (normal distribution about the mean)

Use of the median, in calculating the ideal advance for the pen set in use, reduces the overall banding when there is an outlier pen 134 (for example as before the black pen K, FIG. 10).

The adverse effects of the outlier are compensated less with this algorithm than with the weighted-mean algorithm, but the overall banding performance from the more-nearly-nominal pens 131, 132, 133, 135, 136 is better. Improvement in image quality is small but—when an outlier pen is present—this improvement is ordinarily greater than with the weighted mean.

When the number of pens is an even number—as in the illustrated example, six pens—the median PBF is halfway between the two PBF values 132, 133 at the center of the distribution. In the somewhat unusual example shown, those two values are just below +2 for the magenta pen M, 132, and +3 for the yellow and light-cyan pens Y and $C_L$ in common 135, 133.

The median is thus at about +2½ encoder units for the example. When rounded up, this value becomes 3 units, which by virtue of the common $C_L$ and Y banding factors in the example is unusually remote from the K factor at −4.

Because an outlier 134 pen (here K) cannot attract the median toward itself (or at any rate attracts it no more than if that pen were not an outlier), the outlier pen 134 exerts little or no influence on the performance of all other pens 131, 132, 133, 135, 136. Hence the poor performance of the outlier pen 134 is conspicuous, enabling a user to identify that pen easily by noting the colors associated with observed banding.

The user can then, if desired, replace only the outlier pen 134—greatly mitigating the identification problem described earlier in the "BACKGROUND" section. As for the weighted mean, page size will be inaccurate but constant for a given set of pens.

In this highly specialized environment, the mere substitution of median for mean thus confers an advantage that is not at all self evident from the well-known properties of median and mean considered alone. Rather the described advantage of this form of the invention is rather subtle and even startling.

(e) Retrospective drop-weighted mean (variable, based on quanta of ink fired in last pass)—In this earlier-introduced method, the advance is calculated using a weighted mean, similarly to the arbitrarily-weighted-mean procedure described in subsection (b) above, but with the difference that each weight is a product of a fixed weight $W_1$ (between zero and unity as before) and a variable factor $N_i$ derived from the number of drops fired by the corresponding pen i in the last previous pass:

$$A_P(f_i|_{all\ i}) \equiv A_O\ f_{MWN}$$

where $$f_{MWN} \equiv \frac{\sum N_i W_i F_i}{\sum N_i W_i}$$

$N_i \equiv$ number of drops for pen i, based on last—pass usage $$A_P \equiv A_O \frac{\sum N_i W_i F_i}{\sum N_i W_i}$$

As explained earlier, this approach has two main drawbacks: it invokes usage from a previous pass, which may be wholly different from the usage in the pass and subswath that is about to be printed; and it is based on the raw number of drops printed by each pen, without regard to the different significance of banding that occurs in various tonal ranges.

(f) Prospective density-weighted mean (variable, based on densities in current pass)—This algorithm produces a printing-medium advance that is similar to the method discussed immediately above, but that gives additional weight to colors printing at their most sensitive densities. In other words, special weighting is accorded to the banding factor of each pen that is printing a tonal range in which banding is most conspicuous.

Thus in place of the above-described raw numerical factor $N_i$ for pen i, a sensitivity factor $S_i$ is used. This factor does take into account the number of inkdrops printed by the corresponding pen, though that number is considered in terms of tonal range or density $\rho_i$ for that pen—rather than simply the number of drops as such.

Thus the sensitivity is a function of the tone being printed, $S_i = S_i(\rho_i)$, which in turn depends on the inkdrop count:

$$A_P(f_i|_{all\ i}) \equiv A_O\ f_{MWS}$$

where $$f_{MWS} \equiv \frac{\sum S_i(\rho_i) W_i f_i}{\sum S_i(\rho_i) W_i}$$

$\rho_1 \equiv$ density to print by pen i, based on current—pass usage $S_i(\rho_i) \equiv$ empirical sensitivity of banding to printing density, for color in pen i so $$A_P \equiv A_O \frac{\sum S_i W_i f_i}{\sum S_i W_i}.$$

Figure 11:
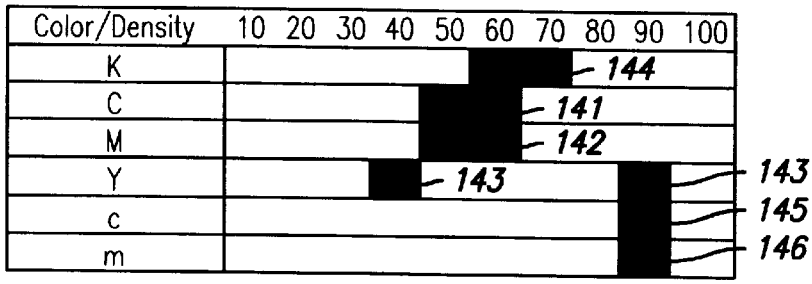
FIG. 11 is a chart showing tonal densities at which banding is most visible to human observers.

The sensitivity factor comes from a lookup table (such as FIG. 11) which relates color i and density $\rho_i$ to the relative conspicuousness of banding. Density increments at least as fine as 5% should be tabulated, based on experiments with standard pens for an intended printer product.

The test prints should be graded by a statistically significant number (such as twenty) of human observers deemed representative of a user population in terms of at least color perception, visual acuity, gender and age. Depending on results of the tabulation, densities at which banding is most visible to observers may be flagged for simple addition of weight (in the tonal ranges 141 through 146 found sensitive, FIG. 11), with no weight being added elsewhere in the tonal scale—i.e., a binary protocol—or may be assigned more-discriminating weights varying in a range of values.

For entering the table, once the table has been thus assembled, an average density for each color in each swath should be calculated from the data before determining the advance for the swath. To find the average densities, the number of inkdrops of each color is advantageously counted in each of many segments across the swath.

This algorithm produces the best image quality, particularly with computer-generated area fills. Page size is constant for a given pen set and a given image, but does not accurately match the page specified in the application program.

7. Scaling

To obtain accurate page sizes with the fixed-advance compensations discussed in subsections 6(a), (b) and (d) above, the page size can be calculated and then scaled by PostScript before printing. For the variable-advance algorithms of 6(c), (e) and (f), however, final page sizes are unknown until processing is complete.

One solution is to calculate page size while processing an image to the computer hard disc. Once the image size is known, PostScript can then scale the image before actually printing it.

A drawback of this latter approach is an increase in processing time required before printing. Accordingly it is advantageous to make the calculation and scaling available as only an optional feature, selected by the user as desired—when both ultimate image quality and accurate page sizes are important enough to justify the slight delay.

In any event the PostScript scaling is done in a sense such as to oppose the final advance factor, and only in the paper axis. For example, if the mean advance factor is 1.002, then the paper-axis scaling should be 1/1.002=0.998.

8. Mechanical and Program/Method Features

The invention is amenable to implementation in a great variety of products. It can be embodied in a printer/plotter that includes a main case 1 (FIG. 16) with a window 2, and a left-hand pod 3 which encloses one end of the chassis. Within that enclosure are carriage-support and -drive mechanics and one end of the printing-medium advance mechanism, as well as a pen-refill station with supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included is a lever 8 for control of the gripping of the print medium by the machine.

A front-panel display 211 and controls 212 are mounted in the skin of the right-hand pod 213. That pod encloses the right end of the carriage mechanics and of the medium advance mechanism, and also a printhead cleaning station. Near the bottom of the right-hand pod for readiest access is a standby switch 214.

Within the case 1 and pods 3, 213 a cylindrical platen 241 (FIG. 18)—driven by a motor 242, worm and worm gear (not shown) under control of signals from a digital electronic processor 71—rotates to drive sheets or lengths of printing medium 4A in a medium-advance direction. Print medium 4A is thereby drawn out of the print-medium roll cover 4.

Meanwhile a pen-holding carriage assembly 220 (FIGS. 17 and 18) carries several pens 223–226 (FIG. 17) back and forth across the printing medium, along a scanning track—perpendicular to the medium-advance direction—while the pens eject ink. For simplicity's sake, only four pens are illustrated; however, as is well known a printer may have six pens (this is the number assumed in the test pattern of FIG. 4) or more, to hold different colors—or different dilutions of the same colors as in the more-typical four pens. The medium 4A thus receives inkdrops for formation of a desired image, and is ejected into the print-medium bin 5.

A very finely graduated encoder strip 233, 236 (FIG. 18) is extended taut along the scanning path of the carriage assembly 220 and read by another, very small automatic optoelectronic sensor 237 to provide position and speed information 237B for the microprocessor. One advantageous location for the encoder strip is shown in several of the earlier cross-referenced patent documents at 236, immediately behind the pens.

A currently preferred position for the encoder strip 233 (FIG. 17), however, is near the rear of the pen-carriage tray—remote from the space into which a user's hands are inserted for servicing of the pen refill cartridges. For either position, the sensor 237 is disposed with its optical beam passing through orifices or transparent portions of a scale formed in the strip.

The pen-carriage assembly 220, 220' (FIG. 18) is driven in reciprocation by a motor 231—along dual support and guide rails 232, 234 (FIG. 17)—through the intermediary of a drive belt 235. The motor 231 is under the control of signals from digital processors 71.

Naturally the pen-carriage assembly includes a forward bay structure 222 for the pens—preferably at least four pens 223–226 holding ink of four different colors respectively. Most typically the inks are yellow in the leftmost pen 223, then cyan 224, magenta 225 and black 226. As a practical matter, chromatic-color and black pens may be in a single printer, either in a common carriage or plural carriages.

Figure 16:
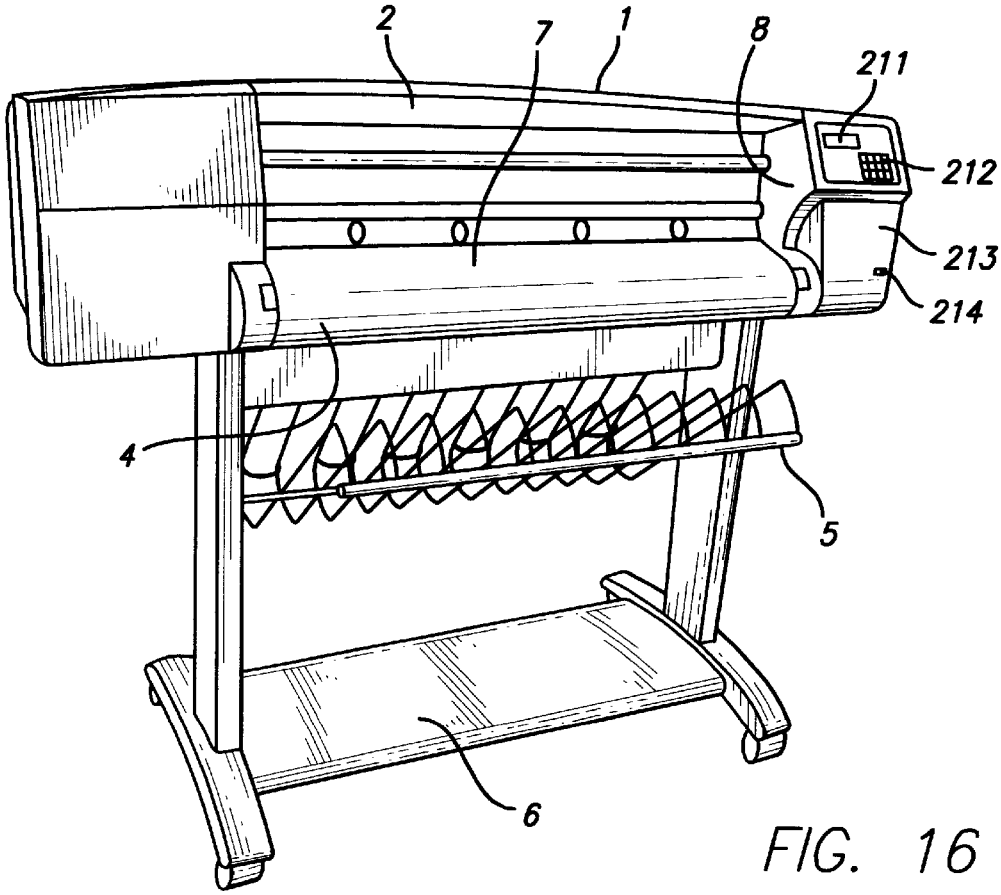
FIG. 16 is a perspective view of the exterior of a printer embodying preferred embodiments of the invention.
Figure 17:
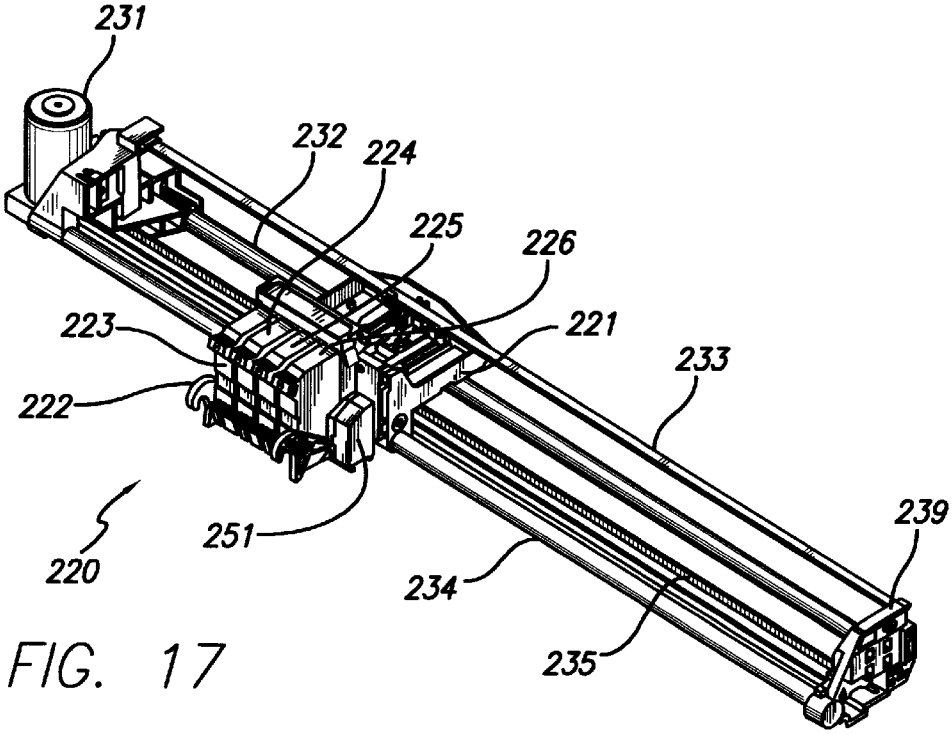
FIG. 17 is a like view of a scanning carriage and medium-advance mechanism in the FIG. 16 printer.

Also included in the pen-carriage assembly 220, 220' is a rear tray 221 carrying various electronics. FIGS. 16 and 17 most specifically represent a system such as the Hewlett Packard printer/plotter model "DesignJet 1000", which does not include the present invention. These drawings, however, also illustrate certain embodiments of the invention, and—with certain detailed differences mentioned below—a printer/plotter that includes preferred embodiments of the invention.

Before further discussion of details in the block diagrammatic showing of FIG. 18, a general orientation to that drawing may be helpful. Most portions 70, 73, 75–78 across the lower half of the diagram, including the printing stage 4A-251 at far right and some aspects of the pass and nozzle assignments 61, are generally conventional and represent the context of the invention in an inkjet printer/plotter.

Most of the elements and subelements in the top portion 63–72, 81 and certain parts 85, 94, 187, 196 of the lower portions of the drawing represent the present invention. (Other elements 82–84, 86–90, 68 are closely related features of the invention discussed in the Cluet document, though not directly of the present invention.) Given the statements of function and the swath diagrams presented in this document, an experienced programmer of ordinary skill in this field can prepare suitable programs for operation of all the circuits.

The pen-carriage assembly is represented separately at 220 when traveling to the left 216 while discharging ink 218, and at 220' when traveling to the right 217 while discharging ink 219. It will be understood that both 220 and 220' represent the same pen carriage.

The previously mentioned digital processor 71 provides control signals 220B to fire the pens with correct timing, coordinated with platen drive control signals 242A to the platen motor 242, and carriage drive control signals 231A to the carriage drive motor 231. The processor 71 develops these carriage drive signals 231A based partly upon information about the carriage speed and position derived from the encoder signals 237B provided by the encoder 237.

(In the block diagram all illustrated signals are flowing from left to right except the information 237B, 65 fed back from the sensors—as indicated by the associated leftward arrow.) The codestrip 233, 236 thus enables formation of color inkdrops at ultrahigh precision during scanning of the carriage assembly 220 in each direction—i.e., either left to right (forward 220') or right to left (back 220).

New image data 70 are received 191 into an image-processing stage 73, which may conventionally include a contrast and color adjustment or correction module 76 and a rendition, scaling etc. module 77.

Information 193 passing from the image-processing modules next enters a printmasking module 74. This may include a stage 61 for specific pass and nozzle assignments. The latter stage 61 performs generally conventional functions, but in accordance with certain aspects of the related invention is preferably constrained by inputs 68 as described in the Cluet document.

Integrated circuits 71 may be distributive—being partly in the printer, partly in an associated computer, and partly in a separately packaged raster image processor. Alternatively the circuits may be primarily or wholly in just one or two of such devices.

These circuits also may comprise a general-purpose processor (e.g. the central processor of a general-purpose computer) operating software such as may be held for instance in a computer hard drive, or operating firmware (e.g. held in a ROM 75 and for distribution 66 to other components), or both; and may comprise application-specific integrated circuitry. Combinations of these may be used instead.

As set forth above, the image to be printed is advantageously a representative test image of numerous color patches or swatches, for reading by an optical sensor to generate calibration data. For present purposes, such test images are particularly, though not exclusively, for use in detecting or correcting for the effects of misdirected printing elements—e.g. here nozzles of the pens.

For generation of such test images, the apparatus of the invention includes—in the integrated-circuit section 71 (FIG. 18)—array-using means 63 that generate control signals 80 for operation of the final output stage 78. These signals drive the printing stage seen at right.

Some portions of FIG. 18 correspond to the last five facets or aspects of the invention discussed in the "SUMMARY OF THE DISCLOSURE" section above—that is, the third through seventh aspects as there presented. In particular, the support for the printing medium mentioned in those aspects is preferably the platen 241. The carriage for holding and scanning the marking devices is preferably the carriage 220, 220' and the printing-medium advance mechanism is preferably the drive and control train 242A, 242. The sensor for measuring test-pattern image quality is preferably the sensor 251; and the programmed processor means preferably encompass pertinent portions of the integrated circuit(s) 71.

These latter means, as will be recalled from the earlier "SUMMARY" section, perform functions that vary somewhat as among the third through seventh aspects of the invention. For instance the third-aspect function of "controlling the carriage, the advance mechanism, and such marking devices to print a test pattern comprising a set of representative image patches at each of plural printing-medium advance settings in turn, each set comprising at least one representative image patch for each of plural different colors" preferably includes the functions performed by the array-using means 63, parameter-varying means 64, signal path 80, and final output stage 78.

The associated function of "operating the sensor and interpreting resulting signals from the sensor to determine optimum printing-medium advance" is symbolized in FIG. 18 by, preferably, the sensor signal collection path 65 and the quality/varying correlating means 81 with related application block 85—in turn supplying control signals 196, 242A for operation of the platen motor 242.

The control signals 80 include a series of different parameters for test. Such a series of parameters may for example include a sequence of different printing-medium advance values, as described in detail above. Each value is duly implemented by the final output stage 78 and its advance-mechanism signals 242A.

These signals 242A are further implemented, in printing of the test images, by the movements of the advance motor 242, drive 241 and medium 4A. The sequence of parameter values is also signaled 91 to quality-measuring means 72, for use in the correlating means 81.

The small automatic optoelectronic sensor 251 rides with the pens on the carriage and is directed downward to obtain data about image quality (here e.g. uniformity in area fills, etc., all as set forth earlier in this document). The sensor 251 signals are coordinated (not shown) with movements of the carriage and advance mechanism, and thereby can readily perform optical measurements 65, 81, 82 (FIG. 18) of the printed test images; suitable algorithmic control 82 is well within the skill of the art, guided by the discussions here.

The quality-measuring means 72 receive measurement data 65 returned from the sensor 251. In the case of the "quality optimization" embodiments discussed above, the quality-measuring means 72 include means 81 for correlating these quality data 65 with the parameter-varying data 91 from the above-mentioned varying means 64.

The correlation data 92 in turn pass to operation-modifying means 83. These operation-modifying means 83 may take any of a very great variety of forms, influencing 94 the establishment 85 of a correspondingly great variety of apparatus settings.

Examples of such parameters include printmode; print-medium advance stroke and speed; scan velocity; inkdrop energies, sizes and velocities; depletion, propletion and discretionary-dotting ratios; balance point between randomization vs. granularity; and nozzle weighting distributions. In any event, the settings in turn pass 187 to the final output stage 78 for control of the printing stage.

A particularly effective form of correlation data 92 relates to variation of the medium-advance parameter. In this case, these data 92 are then passed 93 through the operation-modifying means 83 and on as instructions 94 to the application module 85, specifically to provide control signals 196 for operation 242A of the advance motor 242.

Other portions of FIG. 18 relate to printing-element usage-modifying aspects and embodiments of the invention discussed in the related Cluet document. In this case generally there may be no parameter-varying means 64 or correlating means 81, but there are measurement control signals 80 and resulting measurement data 65.

In this embodiment, the measurement data 65 proceed to means 82 for quantifying the extent to which each image patch is irregular. These quantifying means 82 form part of the quality-measurement means 72, and generate "departure" data 87, 88 for passage to the operation-modifying means 83.

It will be understood that departure data generally 88 may be applied—within the scope of the invention as defined by certain of the appended claims—in a great variety of ways. These may include transmission of adjusting signals generally 90, 68, 94 to the printmasking stage for modification of pass/nozzle assignments 61 or other settings 85, 187, 196 to control the final output stage 78.

A particularly beneficial way, however, of using the departure data is routing 87 of those data to means 84 for deriving reduced element-usage weights. These means advantageously include means 86 for following a formula to derive such weights. The resulting output weights 89 from the formula then become part (or all) of the data 68 to the pass/nozzle assigning module 61.

These two main alternative embodiments are in general compatible with each other and can be practiced together. For best image quality, such combinations are preferred.

In operation the system retrieves its operating program appropriately—i.e., by reading instructions from memory in case of a firmware or software implementation, or by simply operating dedicated hardware in case of an ASIC or like implementation. Once prepared in this way, the method proceeds to the main procedures discussed above.

The above disclosure is intended as merely exemplary, and not to limit the scope of the invention—which is to be determined by reference to the appended claims.

What is claimed is:

1. A test pattern for determining optimum printing-medium advance in an incremental printer that uses an image-marking device which prints in a particular colorant; said pattern comprising:

a printing medium; and marked on the printing medium, plural representative image patches for the particular colorant;

each of the representative image patches comprising plural overlapping swaths of the colorant, corresponding features of said overlapping swaths being spaced by a certain distance selected for each of said patches respectively;

said certain distances being different for the plural patches, respectively.

2. The test pattern of claim 1, for determining optimum advance in said printer wherein the image-marking device comprises plural marking units, marking in plural different particular colorants respectively; and wherein:

said patches comprise for each certain distance a set of plural patches;

each set comprising at least one patch for each of said plural colorants.

3. The test pattern of claim 2, wherein:

in each set, all the patches are adjacent to one another along a scanning direction.

4. The test pattern of claim 3, further comprising:

plural alignment reference lines printed in association with each set.

5. The test pattern of claim 4, wherein:

the alignment reference lines are above each set.

6. The test pattern of claim 5, wherein:

the alignment lines extend across substantially the entire pattern.

7. The test pattern of claim 4, further comprising:

at least one nozzle-conditioning patch associated with each of the representative image patches.

8. The test pattern of claim 3, further comprising:

at least one nozzle-conditioning patch associated with each of the representative image patches.

9. The test pattern of claim 8, wherein:

the nozzle-conditioning patches are adjacent to their associated representative image patches, along the scanning direction.

10. The test pattern of claim 1, further comprising:

at least one nozzle-conditioning patch associated with each of the representative image patches.

11. The test pattern of claim 1, wherein:

the representative image patches comprise area fills.

12. The test pattern of claim 11, wherein:

the area fills are at different tonal levels for at least some of the different colorants, respectively.

13. The test pattern of claim 12, wherein:

the tonal levels are between twenty-five and fifty-five percent for yellow colorant, and between forty-five and seventy-five percent for at least one other substantially undiluted colorant.

14. The test pattern of claim 13, wherein:

the tonal levels are at roughly forty percent for yellow colorant, and roughly sixty percent for the at least one other substantially undiluted colorant.

15. The test pattern of claim 13, wherein:

the tonal levels are between seventy-five and one hundred percent for at least some dilute colorants.

16. The test pattern of claim 13, wherein:

the tonal levels are at roughly ninety percent for at least some dilute colorants.

17. The test pattern of claim 1, wherein:

said certain distances are distributed about a nominal value for the advance distance.

18. A method of determining optimum printing-medium advance in an incremental printer that uses image-marking devices which print in respective different colors or color dilutions; said method comprising the steps of:

printing a test pattern that includes a set of representative image patches at each of plural printing-medium advance settings in turn;

each set comprising at least one representative image patch for each of the different colors or color dilutions; and performing optical measurements of the test pattern to ascertain a relationship between said printing-medium advance settings and resulting image quality of said patches.

19. The method of claim 18, further comprising the step of, in association with each representative image patch or set, printing at least one feature selected from the group consisting of:

a nozzle-conditioning patch;

an alignment reference line.

20. An incremental printer for using image-marking devices to form images on a printing medium; said printer comprising:

a support for such printing medium;

a carriage for holding such marking devices and scanning such marking devices relative to such medium, to form such images on such medium;

a printing-medium advance mechanism for progressively moving such medium relative to the carriage at right angles to the scanning;

a sensor for measuring test-pattern image quality; and programmed processor means for:

controlling the carriage, the advance mechanism, and such marking devices to print a test pattern comprising a set of representative image patches at each of plural printing-medium advance settings in turn, each set comprising at least one representative image patch for each of plural different colors, and operating the sensor and interpreting resulting signals from the sensor to determine optimum printing-medium advance.

21. The incremental printer of claim 20, in further combination with:

said image-marking devices.

22. The combination of incremental printer of claim 21, wherein:

the image-marking devices comprise inkjet pens.

23. The incremental printer of claim 20, wherein the programmed processor means further comprise means for:

determining which particular marking device is most active in a particular swath of a desired image;

determining an optimum medium advance for at least said particular marking device; and employing said optimum advance for said particular device in printing said particular swath.

24. The incremental printer of claim 20, wherein the programmed processor means further comprise means for:

determining the relative degree of activity of each marking device, respectively, in a particular swath of a desired image;

taking said relative degrees of activity into account in determining an optimum medium advance for all the marking devices considered in the aggregate, at said particular swath; and employing said optimum advance in printing said particular swath.

25. An incremental printer for using image-marking devices to form an image on a printing medium; said printer comprising:

a support for such printing medium;

a carriage for holding such marking devices and scanning such marking devices relative to such medium, to form such image on such medium;

a printing-medium advance mechanism for progressively moving such medium relative to the carriage at right angles to the scanning;

a sensor for measuring test-pattern image quality; and programmed processor means for:

operating the sensor and interpreting resulting signals from the sensor to determine optimum printing-medium advance;

thereafter controlling the carriage, the advance mechanism, and such marking devices to employ particular printing-medium advance values while printing such image; and selecting the particular advance values to provide a sequence of values that varies about the determined optimum advance.

26. The printer of claim 25, wherein:

the sequence of values is a pseudorandom sequence perturbed to preferentially include values relatively nearer to the determined optimum advance.

27. The printer of claim 26, wherein:

the sequence of values is obtained by a combination of a normal distribution with a pseudorandom number generator, substantially according to the function $A_P$ exhibited below, $A_P$ being printing-medium advance and $A_P$ being a nominal value of printing-medium advance, $$A_P(f_i|_{all\ i}) \equiv A_O \cdot \mathrm{NORMAL}[f_M(\mathrm{rand}), \sigma_f]$$

with the distribution truncated to the lower and upper PBF values, where $$\mathrm{NORMAL} \equiv \mu + \frac{\sigma}{2}\sqrt{-\sigma^2 \cdot \ln[rand(1)]} \cdot \cos[2\pi\ rand(1)]$$

$\sigma \equiv \sigma_f$, standard deviation of all $f_i$ $$\mu \equiv f_M \equiv \frac{\sum_{i=1}^{N} f_i}{N},$$

N≡number of pens, maximum value of i rand (x)≡a function that generates uniformly distributed random numbers from 0 through x $$\mathrm{NORMAL} \equiv f_M + \frac{\sigma_f}{2}\sqrt{-\sigma_f^2 \cdot \ln[rand(1)]} \cdot \cos[2\pi\ rand(1)]$$

so $$A_P \equiv A_O\left(f_M + \frac{\sigma_f}{2}\sqrt{-\sigma_f^2 \cdot \ln[rand(1)]} \cdot \cos[2\pi\ rand(1)]\right)$$

(truncated as mentioned above).

28. An incremental printer for using image-marking devices to form an image on a printing medium; said printer comprising:

a support for such printing medium;

a carriage for holding such marking devices and scanning such marking devices relative to such medium, to form such image on such medium;

a printing-medium advance mechanism for progressively moving such medium relative to the carriage at right angles to the scanning;

a sensor for measuring test-pattern image quality; and programmed processor means for:

operating the sensor and interpreting resulting signals from the sensor to determine an optimum printing-medium advance for each marking device respectively; and thereafter controlling the carriage, the advance mechanism, and such marking devices to employ a particular printing-medium advance value that is substantially the median of the optimum advances for the image-marking devices respectively.

29. An incremental printer for using image-marking devices to form an image on a printing medium; said printer comprising:

a support for such printing medium;

a carriage for holding such marking devices and scanning such marking devices relative to such medium, to form such image on such medium;

a printing-medium advance mechanism for progressively moving such medium relative to the carriage at right angles to the scanning;

a sensor for measuring test-pattern image quality; and programmed processor means for:

operating the sensor and interpreting resulting signals from the sensor to determine an optimum printing-medium advance for each marking device respectively;

thereafter determining, for a specific image swath, the image density contributed by each marking device respectively; and thereafter controlling the carriage, the advance mechanism, and such marking devices to employ a particular printing-medium advance value that is substantially a sensitivity-weighted mean of the optimum advances for the image-marking devices respectively;

wherein the sensitivity-weighted mean is calculated substantially by weighting an optimum advance value for each marking device by the sensitivity of banding to printing density for a color in that image-marking device respectively.

30. The printer of claim 29, wherein:

the specific image swath is a swath that is prospectively to be printed; and the particular printing-medium advance value is employed for said specific image swath prospectively to be printed.

31. The printer of claim 29, wherein:

the sensitivity-weighted mean is found substantially according to the expression exhibited below.

$$A_P(f_i|_{all\ i}) \equiv A_O\, f_{MWS}$$

where $$f_{MWS} \equiv \frac{\sum S_i(\rho_i) W_i f_i}{\sum S_i(\rho_i) W_i}$$

$\rho_1$≡density to print by pen i, based on current—pass usage $S_1(\rho_i)$≡empirical sensitivity of banding to printing density, for color in pen i so $$A_P \equiv A_O \frac{\sum S_i W_i f_i}{\sum S_i W_i}.$$

32. An incremental printer for using image-marking devices to form an image on a printing medium; said printer comprising:

a support for such printing medium;

a carriage for holding such marking devices and scanning such marking devices relative to such medium, to form such image on such medium;

a printing-medium advance mechanism for progressively moving such medium relative to the carriage at right angles to the scanning;

a sensor for measuring test-pattern image quality; and programmed processor means for:

operating the sensor and interpreting resulting signals from the sensor to determine an optimum printing-medium advance for each marking device respectively;

thereafter determining, for a specific image swath that is prospectively to be printed, a characteristic of the image components to be contributed by each marking device respectively; and thereafter, for said specific image swath that is prospectively to be printed, controlling the carriage, the advance mechanism, and such marking devices to employ a particular printing-medium advance value that is a function of the said determined characteristic of image components to be contributed by each marking device respectively.

33. The printer of claim 32, wherein:

the specific image swath is to be printed substantially immediately.

* * * * *